US010799930B2

(12) United States Patent
Suzuki et al.

(10) Patent No.: US 10,799,930 B2
(45) Date of Patent: Oct. 13, 2020

(54) PRESS FORMING METHOD AND PRESS FORMING APPARATUS

(71) Applicant: NIPPON STEEL & SUMITOMO METAL CORPORATION, Tokyo (JP)

(72) Inventors: Toshiya Suzuki, Amagasaki (JP); Yoshiaki Nakazawa, Takarazuka (JP); Masahiro Nakata, Osaka (JP)

(73) Assignee: NIPPON STEEL CORPORATION, Tokyo (JP)

( * ) Notice: Subject to any disclaimer, the term of this patent is extended or adjusted under 35 U.S.C. 154(b) by 300 days.

(21) Appl. No.: 15/554,277

(22) PCT Filed: Mar. 2, 2016

(86) PCT No.: PCT/JP2016/056498
§ 371 (c)(1),
(2) Date: Aug. 29, 2017

(87) PCT Pub. No.: WO2016/140287
PCT Pub. Date: Sep. 9, 2016

(65) Prior Publication Data

US 2018/0078986 A1 Mar. 22, 2018

(30) Foreign Application Priority Data

Mar. 3, 2015 (JP) ..... 2015-041701

(51) Int. Cl.
*B21D 22/20* (2006.01)
*B21D 22/26* (2006.01)
*B21D 24/04* (2006.01)

(52) U.S. Cl.
CPC ..... *B21D 22/20* (2013.01); *B21D 22/26* (2013.01); *B21D 24/04* (2013.01)

(58) Field of Classification Search
CPC ..... B21D 22/20; B21D 22/21; B21D 22/24; B21D 22/26; B21D 24/04; B21D 24/06;
(Continued)

(56) References Cited

U.S. PATENT DOCUMENTS

2007/0125149 A1* 6/2007 Yoshitome ..... B21D 53/88 72/356
2012/0279273 A1 11/2012 Tsuchiya et al.
(Continued)

FOREIGN PATENT DOCUMENTS

AT 504783 B1 * 8/2007 ..... B21D 22/06
AT 504783 B1 * 8/2008 ..... B21D 22/22
(Continued)

OTHER PUBLICATIONS

Translation: AT504783B1, Author: Weba, Tanslated: Jan. 2020 (Year: 2007).*
(Continued)

*Primary Examiner* — Adam J Eiseman
*Assistant Examiner* — Matthew Kresse
(74) *Attorney, Agent, or Firm* — Birch, Stewart, Kolasch & Birch, LLP

(57) ABSTRACT

This press forming method is a press forming method of manufacturing a press-formed article from a workpiece sheet using a press forming apparatus including a punch, a die, a punch pad, and a die pad, in which, when the workpiece sheet is clamped between the die and the punch, a surface of the workpiece sheet on a die side in a section between a point in contact with a die bottom end shoulder portion and a point in contact with the die pad is in non-contact with the die and the die pad, and an end surface of a punch side blank holding surface adjacent to a punch
(Continued)

shoulder portion is flush with the punch shoulder portion or located on a more inner side of the punch than the punch shoulder portion.

16 Claims, 24 Drawing Sheets

(58) Field of Classification Search
CPC ..... B21D 24/08; B21D 24/10; B21D 22/02; B21D 22/06; B21D 22/10; B21D 22/22; B21D 53/88; B21D 5/01
See application file for complete search history.

(56) References Cited

U.S. PATENT DOCUMENTS

| | | | | |
|---|---|---|---|---|
| 2014/0356643 | A1* | 12/2014 | Nakata | B21D 22/26 428/603 |
| 2015/0224563 | A1* | 8/2015 | Aso | B21D 22/26 428/595 |
| 2016/0121384 | A1* | 5/2016 | Sumikawa | B21D 22/26 72/352 |

FOREIGN PATENT DOCUMENTS

| | | | |
|---|---|---|---|
| CN | 102764807 | A | 11/2012 |
| CN | 103223441 | A | 7/2013 |
| CN | 104136142 | A | 11/2014 |
| EP | 2 711 104 | A1 | 3/2014 |
| EP | 2 796 221 | A1 | 10/2014 |
| EP | 3 406 364 | A1 | 11/2018 |
| JP | 2002-263744 | A | 9/2002 |
| JP | 2010-082660 | A | 4/2010 |
| JP | 2012-051005 | A | 3/2012 |
| JP | 2012-232329 | A | 11/2012 |
| JP | 2013-151003 | A | 8/2013 |
| SU | 1018751 | A | 5/1983 |
| SU | 1329868 | A1 | 5/1987 |
| TW | 200404625 | A | 4/2004 |
| WO | WO 2013/094705 | A1 | 6/2013 |
| WO | 2014/148618 | A1 | 9/2014 |

OTHER PUBLICATIONS

Extended European Search Report dated Feb. 12, 2019, in European Patent Application No. 16758980.3.
International Search Report (PCT/ISA/210) issued in PCT/JP2016/056498, dated May 10, 2016.
Office Action issued in Taiwanese Patent Application No. 105106497, dated Apr. 20, 2017.
Written Opinion (PCT/ISA/237) issued in PCT/JP2016/056498, dated May 10, 2016.
Office Action dated Sep. 28, 2018, in Russian Patent Application No. 2017131425/02(055001), with English translation.
Chinese Office Action and Search Report for Chinese Application No. 201680012857.2, dated Jun. 27, 2018, with English translation of the Search Report.

* cited by examiner

PRESS FORMING METHOD AND PRESS FORMING APPARATUS

TECHNICAL FIELD

The present invention relates to a press forming method and a press forming apparatus capable of manufacturing a high-strength press-formed article having a hat-shaped cross section, a groove-shaped cross section, or the like with excellent dimensional accuracy while suppressing the occurrence of opening after press forming.

Priority is claimed on Japanese Patent Application No. 2015-041701, filed Mar. 3, 2015, the content of which is incorporated herein by reference.

BACKGROUND ART

High tensile strength steel sheets are widely used as constituent members of automobile bodies in order to achieve advanced fuel economy to prevent global warming and to achieve further advanced safety during collision accidents. For example, strength members and reinforcing members such as side sills and side members among the constituent members of an automobile body are designed with considerable restrictions such as preventing interference with other parts and ensuring a desired space and accordingly, strict dimensional accuracy is often required.

However, as the strength of the steel sheet increases, the formability of the steel sheet decreases. Therefore, when press forming is performed on a high-strength steel sheet to manufacture, for example, a side sill inner panel having a hat-shaped cross section, a spring back tends to occur in the obtained press-formed article. If a spring back occurs, problems and yields decrease arise in subsequent procedures (for example, a welding procedure). For this reason, it is strongly required to suppress the spring back in a press-formed article constituted by a high-strength steel sheet.

FIGS. 15A to 15D are explanatory diagrams schematically showing, as a first conventional example, a situation where press working is performed on a workpiece sheet 1001, which is a high-strength steel sheet, by bending forming using a press forming apparatus 1000 such that a press-formed article 1005 having a hat-shaped transverse cross-sectional shape is manufactured.

First, as shown in FIG. 15A, the workpiece sheet 1001 is clamped between a top surface 1002*a* of a punch 1002 and a die pad 1004 provided in a die 1003 to perform positioning. Next, the punch 1002 is pushed relatively into the die 1003 as shown in FIG. 15B and additionally, the punch 1002 and the die 1003 are brought closest to each other as shown in FIG. 15C, whereby the workpiece sheet 1001 is press-formed. Thereafter, as shown in FIG. 15D, the press-formed article 1005 having a hat-shaped transverse cross-sectional shape is manufactured after the die 1003 is released. However, in the press-formed article 1005 formed in this manner, a spring back sometimes occurs, such as an angular change in a ridgeline 1005*b* connecting to a top sheet 1005*a* and a wall warp in a vertical wall 1005*c* connecting to the ridgeline 1005*b*.

FIGS. 16A to 16F are explanatory diagrams showing, as a second conventional example, a press forming method that suppresses the above-mentioned wall warp using press forming apparatuses 2000A and 2000B.

In this forming method, press forming is performed on a workpiece sheet 2001 using a pre-working punch 2006 and a pre-working die 2007 in a first procedure shown in FIGS. 16A and 16B such that a portion 2001*a* to be formed into a flange 2005*d* of a press-formed article 2005 is formed. Subsequently, in a second procedure shown in FIGS. 16C to 16E, the portion 2001*a* and the workpiece sheet 2001 in which the portion 2001*a* is formed are clamped between a top surface 2002*a* of a punch 2002 and a die pad 2004 provided in a die 2003 to perform positioning and then, the punch 2002 is pushed relatively into the die 2003. In a case where the workpiece sheet 2001 is press-formed in this manner, it is possible to suppress a wall warp in the obtained press-formed article 2005. However, even with this forming method, an angular change in the ridgeline 2005*b* of the press-formed article 2005 is not eliminated.

In Patent Documents 1 and 2, the applicant of the present invention has disclosed an invention that suppresses opening due to an angular change in a vertical wall of a press-formed article using a die having a die pad arranged so as to freely move in and out and a punch having a punch pad arranged so as to freely move in and out. FIGS. 17A to 17D are explanatory diagrams showing, as a third conventional example, a press forming method disclosed in Patent Document 2.

As shown in FIG. 17A, this press forming method uses a press forming apparatus 3000 constituted by a die 3009 having a die pad 3008 arranged so as to freely move in and out and a punch 3011 having a punch pad 3010 arranged so as to freely move in and out. Then, as shown in FIGS. 17B and 17C, press forming is started in a state where a workpiece sheet 3001 in which a portion 3001*a* corresponding to a flange is formed is clamped between the die pad 3008 and the punch pad 3010, while a predetermined amount of initial deflection is generated in a portion to be formed into an end portion of a top sheet 3005*a*. Additionally, as shown in FIG. 17D, this deflection is crushed in a state where the die 3009 and the punch 3011 are closest to each other (forming bottom dead center). According to such a press forming method, opening of a vertical wall 3005*c* due to the angular change in a ridgeline 3005*b* of a press-formed article 3005 can be suppressed.

FIG. 18 is an explanatory diagram for explaining the principle of suppressing the opening of the vertical wall 3005*c* due to the angular change in the ridgeline 3005*b* of the press-formed article 3005 by the press forming method using the press forming apparatus 3000 shown in FIGS. 17A to 17D.

As shown in FIG. 18, in this press forming method, the deflection imparted to the workpiece sheet 3001 by the die pad 3008 and the punch pad 3010 during press forming is crushed at a final phase of forming (forming bottom dead center). With this, a closing direction moment can be generated at a region extending from a portion of the workpiece sheet 3001 to be formed into the ridgeline 3005*b* to a portion thereof to be formed into the vertical wall 3005*c* (portion A in FIG. 18) and a region to which the deflection is imparted (portion B in FIG. 18). Accordingly, an opening moment generated in the ridgeline is canceled out and it is thus possible to suppress the opening of the vertical wall 3005*c*.

CITATION LIST

Patent Document

[Patent Document 1]

Japanese Unexamined Patent Application, First Publication No. 2010-82660

[Patent Document 2]

Japanese Unexamined Patent Application, First Publication No. 2012-51005

SUMMARY OF INVENTION

Problems to be Solved by the Invention

FIG. 19 is an explanatory diagram showing an example of a cross-sectional shape of the press-formed article 3005 manufactured using the press forming method disclosed in Patent Document 2 (third conventional example).

In the press forming method disclosed in Patent Document 2, the inventors of the present invention have found that, when a height h of the press-formed article 3005 increases, a setting allowable range of an initial deflection amount for keeping the dimensional accuracy of the opening of the vertical wall 3005*c* within a tolerance becomes narrow (for example, 0.5 mm) and accordingly, management of the initial deflection amount becomes sometimes virtually difficult in the actual production site.

In the press forming method disclosed in Patent Document 2, the inventors also have found that a predetermined initial deflection amount (a distance from a punch shoulder portion to the workpiece sheet 3001 located above; for example, 10 mm) is imparted by the die pad 3008 and the punch pad 3010 such that a portion of the workpiece sheet 3001 during press forming to be formed into the end portion of the top sheet 3005*a* is deflected when press forming is performed and therefore, as shown in FIG. 19, bending tendencies 3005*e* and 3005*e* resulting from the deflection during forming remain in the top sheet 3005*a* of the press-formed article 3005; as a consequence, the dimensional accuracy of the top sheet 3005*a* does not fall within the tolerance in some cases.

An object of the present invention is to provide, for a press forming method in which a predetermined amount of deflection is generated in a top sheet from an initial phase of forming while press forming is performed and this deflection is crushed in a later phase of forming as in the inventions disclosed in Patent Documents 1 and 2, a technology that uses a simple method to enable the enlargement of a setting allowable range of an initial deflection amount for ensuring the dimensional accuracy of opening of a vertical wall and additionally, the improvement of the dimensional accuracy of a top sheet surface resulting from the deflection generated in an end portion of the top sheet during press forming.

Means for Solving the Problem

The gist of the present invention is as follows.

(1) A first aspect of the present invention is a press forming method of manufacturing a press-formed article from a workpiece sheet using a press forming apparatus including: a punch formed with a punch shoulder portion, a punch shoulder joint portion, and a punch pad accommodation portion; a die arranged to oppose the punch and formed with a die bottom end shoulder portion corresponding to the punch shoulder portion, a die bottom end shoulder joint portion, and a die pad accommodation portion provided in the die bottom end shoulder joint portion; a punch pad arranged in the punch pad accommodation portion and formed with a punch side blank holding surface; and a die pad arranged in the die pad accommodation portion and formed with a die side blank holding surface, in which, when the workpiece sheet is clamped between the die and the punch, a surface of the workpiece sheet on a die side in a section between a point in contact with the die bottom end shoulder portion and a point in contact with the die pad is in non-contact with the die and the die pad, and an end surface of the punch side blank holding surface adjacent to the punch shoulder portion is flush with the punch shoulder portion or located on a more inner side of the punch than the punch shoulder portion.

(2) In the press forming method according to the above (1), when the workpiece sheet is clamped between the die and the punch, the end surface of the punch side blank holding surface adjacent to the punch shoulder portion may be flush with the punch shoulder portion.

(3) In the press forming method according to the above (2), the die pad may be further pushed into a punch side from a state in which the workpiece sheet is clamped between the die and the punch.

(4) In the press forming method according to the above (1), when the workpiece sheet is clamped between the die and the punch, the end surface of the punch side blank holding surface adjacent to the punch shoulder portion may be located on a more inner side of the punch than the punch shoulder portion.

(5) The press forming method according to any one of the above (1) to (4) may be bending forming.

(6) A second aspect of the present invention is a press forming apparatus including: a punch formed with a punch shoulder portion, a punch shoulder joint portion, and a punch pad accommodation portion; a die arranged to oppose the punch and formed with a die bottom end shoulder portion corresponding to the punch shoulder portion, a die bottom end shoulder joint portion, and a die pad accommodation portion provided in the die bottom end shoulder joint portion; a punch pad arranged in the punch pad accommodation portion and formed with a punch side blank holding surface; and a die pad arranged in the die pad accommodation portion and formed with a die side blank holding surface, in which the punch is formed with a recess portion provided on a more inner side of the punch than the punch shoulder portion in a section from the punch shoulder portion to an edge of the punch pad accommodation portion.

(7) A third aspect of the present invention is a press forming apparatus including: a punch formed with a punch shoulder portion, a punch shoulder joint portion, and a punch pad accommodation portion; a die arranged to oppose the punch and formed with a die bottom end shoulder portion corresponding to the punch shoulder portion, a die bottom end shoulder joint portion, and a die pad accommodation portion provided in the die bottom end shoulder joint portion; a punch pad arranged in the punch pad accommodation portion and formed with a punch side blank holding surface; and a die pad arranged in the die pad accommodation portion and formed with a die side blank holding surface, in which the die bottom end shoulder joint portion of the die is formed with a recess portion provided on a more inner side of the die than the die bottom end shoulder portion in a section from the die bottom end shoulder portion to an edge of the die pad accommodation portion.

(8) A fourth aspect of the present invention is a press forming apparatus including: a punch formed with a punch shoulder portion, a punch shoulder joint portion, and a punch pad accommodation portion; a die arranged to oppose the punch and formed with a die bottom end shoulder portion corresponding to the punch shoulder portion, a die bottom end shoulder joint portion, and a die pad accommodation portion provided in the die bottom end shoulder joint portion; a punch pad arranged in the punch pad accommodation portion and formed with a punch side blank holding surface; and a die pad arranged in the die pad accommodation portion and formed with a die side blank holding surface, in which the punch is provided with the punch pad accommodation portion with the punch shoulder portion as an edge, and a width of the punch side blank holding surface is narrower than a width of the punch pad accommodation portion and an end portion of the punch side blank holding surface is located at the same position as an end portion of the die side blank holding surface on a plane perpendicular to a pressing direction.

(9) A fifth aspect of the present invention is a press forming apparatus including: a punch formed with a punch shoulder portion, a punch shoulder joint portion, and a punch pad accommodation portion; a die arranged to oppose the punch and formed with a die bottom end shoulder portion corresponding to the punch shoulder portion, a die bottom end shoulder joint portion, and a die pad accommodation portion provided in the die bottom end shoulder joint portion; a punch pad arranged in the punch pad accommodation portion and formed with a punch side blank holding surface; and a die pad arranged in the die pad accommodation portion and formed with a die side blank holding surface, in which the die is provided with the die pad accommodation portion with an end of the die bottom end shoulder portion as an edge, and a width of the die side blank holding surface is narrower than a width of the die pad accommodation portion and an end portion of the die side blank holding surface is located at the same position as an end portion of the punch side blank holding surface on a plane perpendicular to a pressing direction.

(10) In the press forming apparatus according to any one of the above (6) to (9), in a state in which the punch and the die are closest to each other, the die and the die pad may be in non-contact with a residual deflection (bulging portion) of the workpiece sheet corresponding to an area from the punch shoulder portion to an end portion of the die side blank holding surface of the die pad.

(11) The press forming apparatus according to any one of the above (6) to (10) may further include a driving unit that pushes the die pad toward the punch from a state in which the die and the punch are closest to each other.

(12) In the press forming apparatus according to any one of the above (6) to (11), a width of the die side blank holding surface may be substantially equal to a width of the punch side blank holding surface.

(13) The press forming apparatus according to any one of the above (6) to (12) may be a cold press forming apparatus.

Effects of the Invention

According to the present invention, in a state in which the punch and the die are closest to each other, a residual deflection (a bulging portion having a minute curvature shape) at a deflection region formed at an end portion of the top sheet of the workpiece sheet is not compressed during press forming and thus, it is possible to suppress the occurrence of a moment which occurs when this residual deflection is crushed.

That is, a gap can be provided between the punch, the die, and the workpiece sheet from an R-finish of a portion of the workpiece sheet to be formed into the top sheet to a position where the workpiece sheet is in contact with end portions of the die pad and the punch pad. It is thus possible to suppress the fluctuation of a closing direction moment generated in the portion of the workpiece sheet to be formed into the top sheet irrespective of the initial deflection amount and to widen the setting allowable range of the initial deflection amount.

Accordingly, it is possible to enable, using a simple method, the enlargement of the setting allowable range of the initial deflection amount for ensuring the dimensional accuracy by keeping the opening of the vertical wall within the tolerance.

Furthermore, in a case where the end surface of the punch side blank holding surface adjacent to the punch shoulder portion is pushed into a more inner side of the punch than the punch shoulder portion when the workpiece sheet is clamped between the die and the punch, a bending tendency of the top sheet can be eliminated and the dimensional accuracy of the top sheet can be ensured.

EMBODIMENTS OF THE INVENTION

As a result of intensive studies to solve the above-mentioned problems, the inventors of the present invention have obtained the findings (A) to (C) listed below to complete the present invention.

(A) When a pushing shape in a direction opposite to a deflection direction generated in a portion of a workpiece sheet to be formed into a top sheet is imparted during press forming at a forming bottom dead center, and a gap is provided between a die and a die pad and the workpiece sheet from an R-finish of the portion of the workpiece sheet to be formed into the top sheet to a position where the workpiece sheet is in contact with an end portion of the die pad, it is possible to suppress the fluctuation of a closing direction moment generated in a portion of the workpiece sheet to be formed into an end portion of the top sheet irrespective of an initial deflection amount and to widen a setting allowable range of the initial deflection amount.

(B) In a press forming method in which, at the start of press forming, the workpiece sheet is clamped between the die pad and a punch pad at a position closer to the die than a punch shoulder portion and, during the press forming, a predetermined amount of deflection is imparted to the portion of the workpiece sheet to be formed into the end portion of the top sheet when forming is performed such that this deflection is compressed at a final phase of press forming, when a recess portion having a predetermined depth is provided inside a top surface of a punch facing the portion of the workpiece sheet to be formed into the end portion of the top sheet such that a predetermined amount that cancels a bending tendency of the top sheet of the press-formed article is pushed in a depth direction of the recess portion at the forming bottom dead center, the bending tendency of the top sheet can be eliminated, the dimensional accuracy of the top sheet can be ensured, and the gap described in (A) can be provided between the die and the die pad and the workpiece sheet.

(C) When the portion of the workpiece sheet to be formed into the top sheet is pushed with the die pad in the depth direction of the recess portion at the forming bottom dead center, the workpiece sheet being formed is clamped between the die and the punch such that a predetermined pressurizing force is loaded thereon, whereby the workpiece sheet can be pushed while tension is imparted thereto. Therefore, the residual deflection can be reduced at the end portion of the top sheet and the dimensional accuracy of the top sheet can be ensured.

Hereinafter, the present invention made on the basis of the above new findings will be described in detail on the basis of embodiments.

Figure 1:
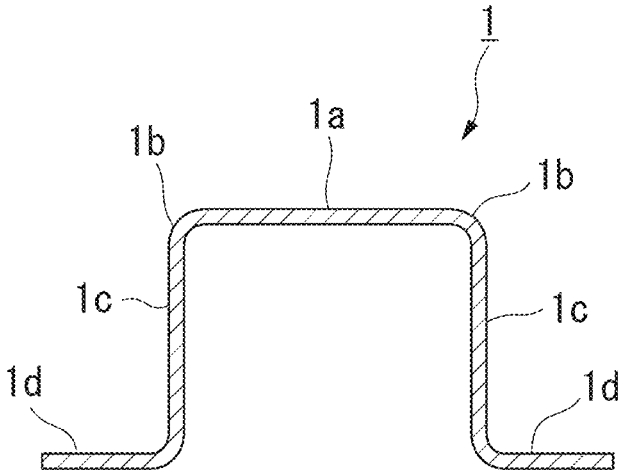
FIG. 1 is an explanatory diagram showing a cross-sectional shape of a press-formed article manufactured according to an embodiment of the present invention.

The following embodiments will describe a case where a press-formed article having a hat-shaped transverse cross-sectional shape as shown in FIG. 1 (hereinafter referred to as press-formed article 1) is manufactured by press-working a steel sheet S as a workpiece sheet with a cold press forming apparatus.

This press-formed article 1 has a top sheet 1*a*, a pair of ridgelines 1*b* and 1*b* continuing to the top sheet 1*a*, a pair of vertical walls 1*c* and 1*c* continuing to the pair of ridgelines 1*b* and 1*b*, respectively, and flanges 1*d* and 1*d* continuing to the two vertical walls 1*c* and 1*c*, respectively.

First Embodiment

Figure 16A:
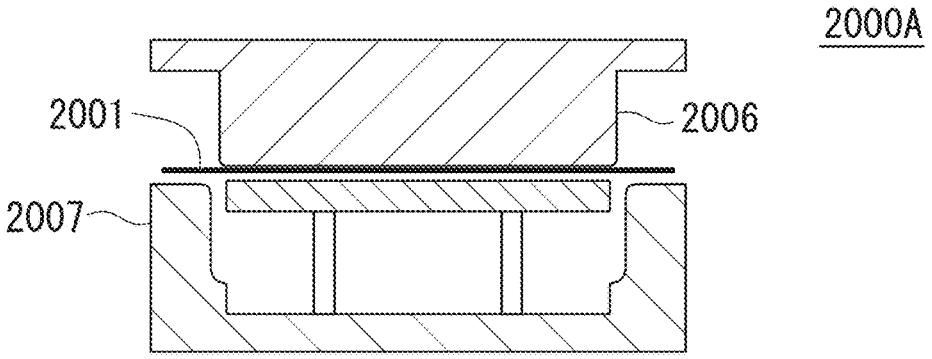
FIG. 16A is a schematic diagram for explaining a press forming method according to a second conventional example, showing a state in which a steel sheet is clamped between a pre-working die and a punch pad of a pre-working punch.
Figure 16B:
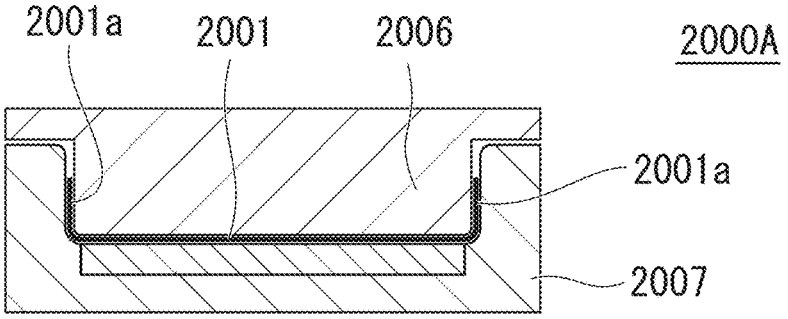
FIG. 16B is a schematic diagram for explaining the press forming method according to the second conventional example, showing a state in which the pre-working die and the pre-working punch are brought closest to each other to pre-work the steel sheet.
Figure 16C:
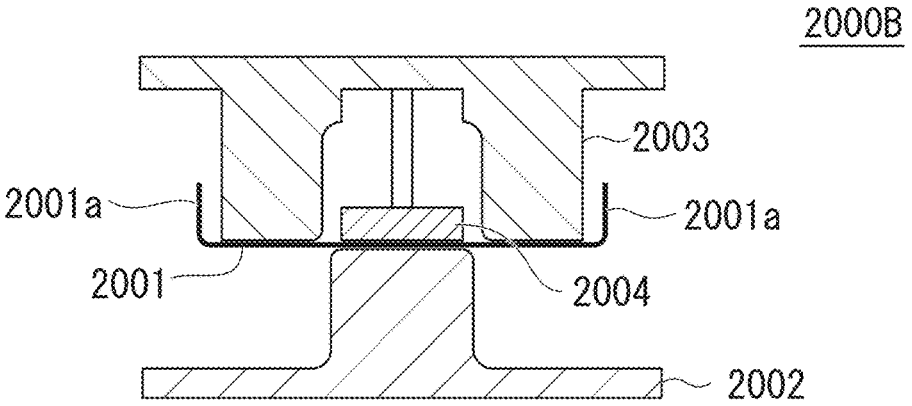
FIG. 16C is a schematic diagram for explaining the press forming method according to the second conventional example, showing a state in which the pre-worked steel sheet is clamped between a die pad and a punch.
Figure 16D:
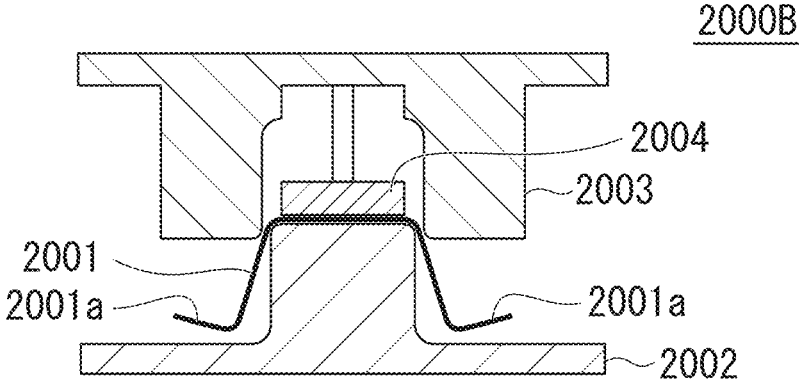
FIG. 16D is a schematic diagram for explaining the press forming method according to the second conventional example, showing a state in which a die is lowered while the pre-worked steel sheet is clamped between the die pad and the punch.
Figure 16E:
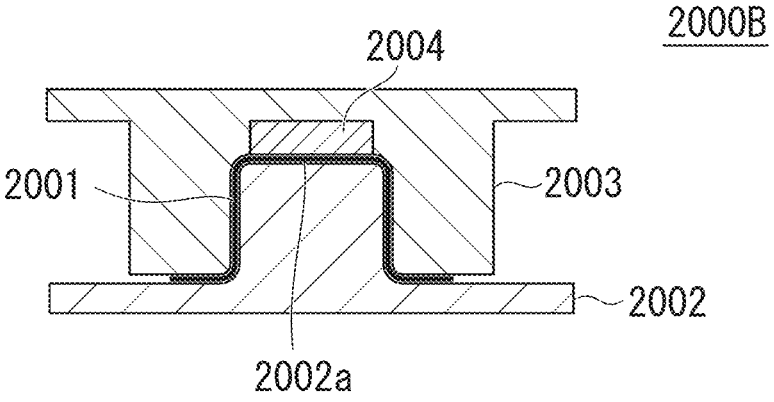
FIG. 16E is a schematic diagram for explaining the press forming method according to the second conventional example, showing a state in which the die and the punch are closest to each other.
Figure 16F:
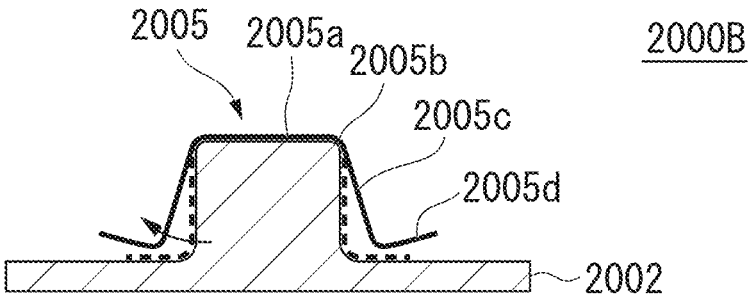
FIG. 16F is a schematic diagram for explaining the press forming method according to the second conventional example, showing a state in which the die is released.
Figure 17A:
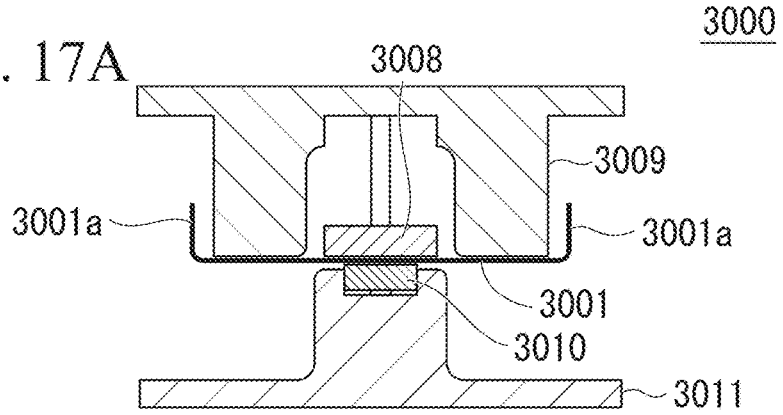
FIG. 17A is a schematic diagram for explaining a press forming method according to a third conventional example, showing a state in which a steel sheet is clamped between a die pad and a punch pad.
Figure 17B:
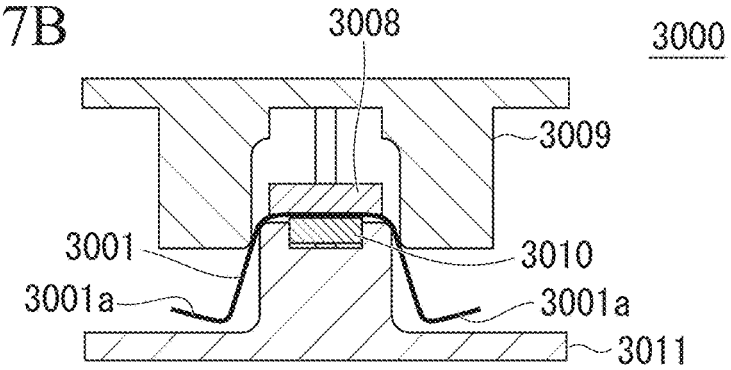
FIG. 17B is a schematic diagram for explaining the press forming method according to the third conventional example, showing a state of an initial stage in which a die is lowered while the steel sheet is clamped between the die pad and the punch pad.
Figure 17C:
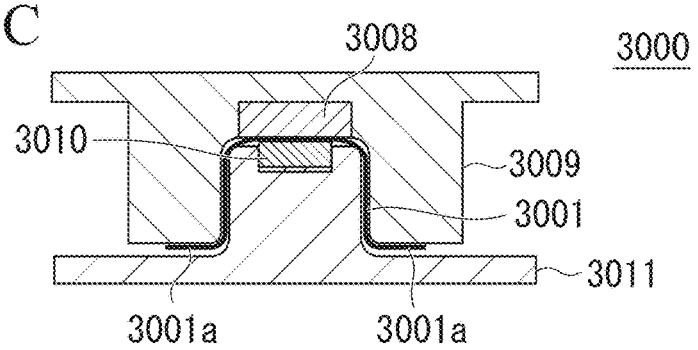
FIG. 17C is a schematic diagram for explaining the press forming method according to the third conventional example, showing a state of a later stage in which the die is lowered while the steel sheet is clamped between the die pad and the punch pad.
Figure 17D:
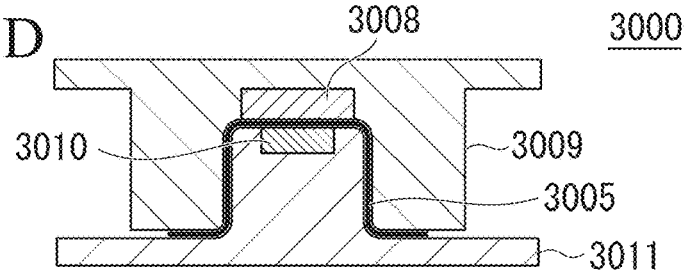
FIG. 17D is a schematic diagram for explaining the press forming method according to the third conventional example, showing a state in which the die and a punch are closest to each other.

A forming press method according to a first embodiment of the present invention will be described with reference to FIGS. 2A to 2E. In the present embodiment, the press-formed article 1 is manufactured by press-working the steel sheet S using a press forming apparatus 100. A steel sheet pre-worked by press forming shown in FIGS. 16A and 16B is used as the steel sheet S. FIGS. 2A to 2E are explanatory diagrams showing processes of manufacturing the press-formed article 1 from the steel sheet S with the press forming apparatus 100 with the lapse of time. Note that, in FIGS. 2A to 2E, a Y direction is a press forming direction and an X direction is a width direction.

(Press Forming Apparatus 100)

Figure 2A:
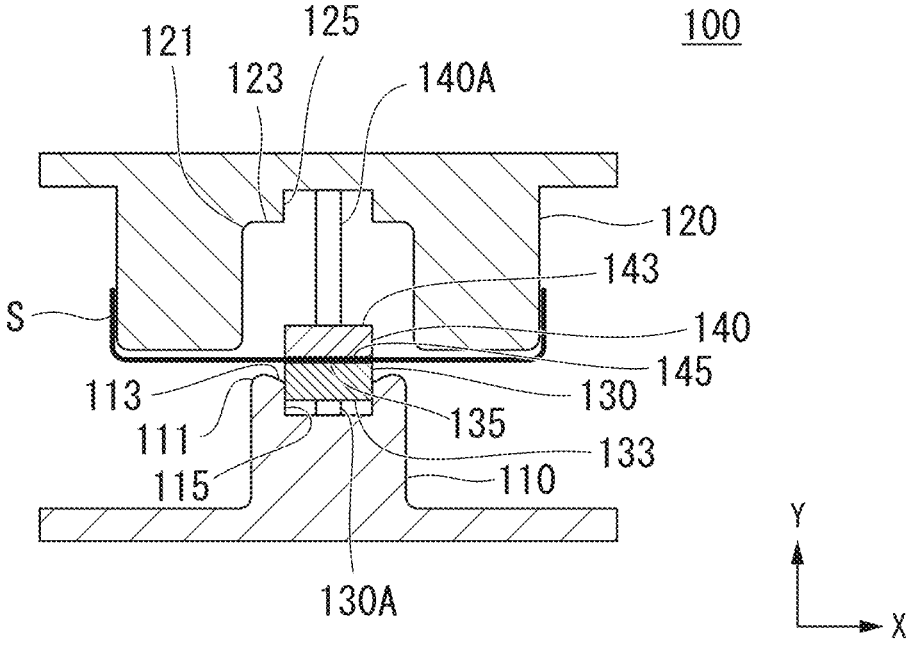
FIG. 2A is a schematic diagram for explaining a press forming method according to a first embodiment of the present invention, showing a state in which a steel sheet is clamped between a die pad and a punch pad.

As shown in FIG. 2A, the press forming apparatus 100 is constituted by a punch 110, a die 120, a punch pad 130, and a die pad 140.

(Punch 110)

The punch 110 is arranged to oppose the die 120 such that the steel sheet S is sandwiched therebetween and has a pair of punch shoulder portions 111, a punch shoulder joint portion 113, and a punch pad accommodation portion 115.

Each of the pair of punch shoulder portions 111 is a region corresponding to an R portion on an inner side surface (a surface on the side of the punch 110) of each of the ridgelines 1*b* and 1*b* of the press-formed article 1.

The punch shoulder joint portion 113 is a region formed so as to connect the punch shoulder portion 111 and the punch pad accommodation portion 115 on an upper surface of the punch 110. In the present embodiment, the punch shoulder joint portion 113 has a shape recessed from the punch shoulder portion 111 through the punch pad accommodation portion 115.

The punch pad accommodation portion 115 is a depression formed so as to be able to accommodate the punch pad 130 at least in a part between the pair of punch shoulder portions 111.

(Die 120)

The die 120 is arranged to oppose the punch 110 such that the steel sheet S is sandwiched therebetween and has a pair of die bottom end shoulder portions 121, a die bottom end shoulder joint portion 123, and a die pad accommodation portion 125.

Each of the die bottom end shoulder portions 121 is a region corresponding to an outer side surface (a surface on the side of the die 120) of each of the ridgelines 1*b* and 1*b* of the press-formed article 1. In the example shown in the present embodiment, the die bottom end shoulder portion 121 is formed as an R portion having a predetermined radius of curvature. However, the die bottom end shoulder portion 121 may be formed by a corner portion having a predetermined angle. In a case where the die bottom end shoulder portion 121 is formed by an R portion having a predetermined radius of curvature, the die bottom end shoulder portion 121 is a region between two R-finishes in the R portion.

The die bottom end shoulder joint portion 123 is a region formed so as to connect the die bottom end shoulder portion 121 and the die pad accommodation portion 125.

The die pad accommodation portion 125 is a depression formed so as to be able to accommodate the die pad 140 at least in a part between the pair of die bottom end shoulder portions 121.

(Punch Pad 130)

The punch pad 130 is arranged so as to be able to be accommodated in the punch pad accommodation portion 115 formed in the punch 110. The punch pad 130 has a shaft fixing surface 133 to which one end of a shaft 130A movable in the press forming direction is fixed and a punch side blank holding surface 135 that clamps the steel sheet S together with the die pad 140. Another end of the shaft 130A is supported by the punch 110 via a pressurizing support mechanism such as a gas cushion (not shown). Alternatively, the another end of the shaft 130A may be supported using a cushion mechanism installed on a bolster of a press machine (not shown).

In addition, while the shaft fixing surface 133 is in contact with a bottom surface of the punch pad accommodation portion 115, the punch side blank holding surface 135 is located at a position lower than the punch shoulder portion 111.

(Die Pad 140)

The die pad 140 is arranged in the die pad accommodation portion 125 formed in the die 120. The die pad 140 has a shaft fixing surface 143 to which one end of a shaft 140A movable in the press forming direction is fixed and a die side blank holding surface 145 that clamps the steel sheet S together with the punch pad 130.

Another end of the shaft 140A is supported by the die 120 via a pressurizing support mechanism such as a gas cushion (not shown). Alternatively, the another end of the shaft 140A may be supported using a cushion mechanism installed on a slide of a press machine (not shown).

It is preferable that the width of the die side blank holding surface 145 be set to be substantially equal to the width of the punch side blank holding surface 135. However, it is allowable that the width of the die side blank holding surface 145 is wider than the width of the punch side blank holding surface 135 within a range of 6 mm or less, that is, one end surface of the die side blank holding surface 145 projects from one end surface of the punch side blank holding surface 135 in the width direction within a range of 3 mm or less.

In addition, the width of each of the die side blank holding surface 145 and the punch side blank holding surface 135 is narrower than the width between the pair of punch shoulder joint portions 113 and 113 and preferably, a difference therebetween is equal to or more than a sheet thickness of the steel sheet S on one side. It is desirable that the difference be set to 5 mm or more on one side (to ensure a width of 5 mm or more on one side for a gap provided between the die 120 and the steel sheet S). If the difference is smaller than 5 mm, since the thickness of the punch shoulder portion 111 becomes thin and the strength thereof thus becomes insufficient, there is a possibility that the punch 110 may be damaged by pressurization at the forming bottom dead center (in a state in which the punch 110 and the die 120 are closest to each other).

In the press forming method according to the present embodiment, the press-formed article 1 is manufactured from the steel sheet S using the above-described press forming apparatus 100 through the following procedures.

(Step 1)

First, as shown in FIG. 2A, the steel sheet S is clamped between the punch pad 130 and the die pad 140 at a position closer to the die 120 than the punch shoulder portion 111.

(Step 2)

Figure 2B:
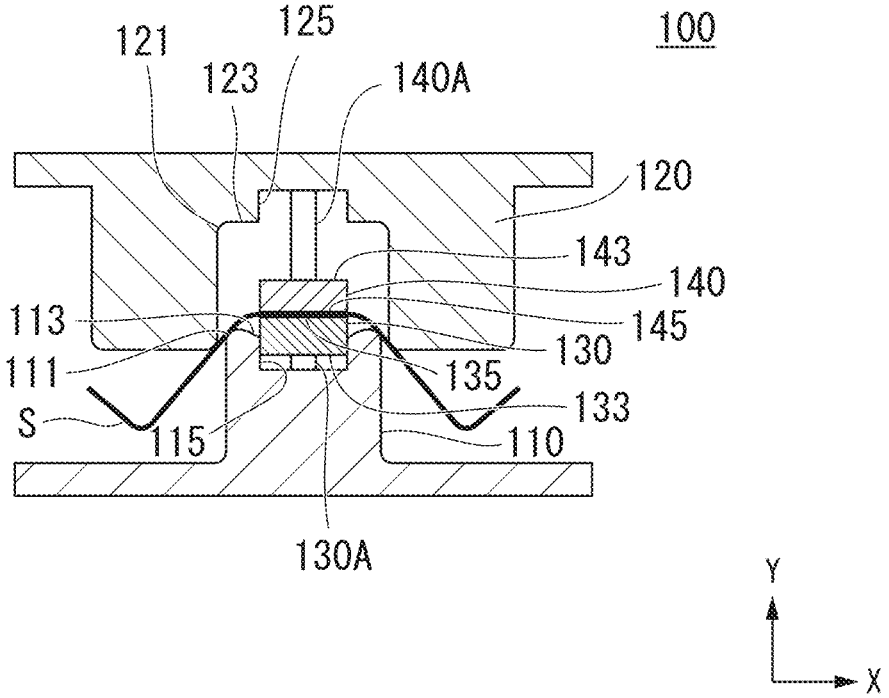
FIG. 2B is a schematic diagram for explaining the press forming method according to the first embodiment, showing a state of an initial stage in which a die is lowered while the steel sheet is clamped between the die pad and the punch pad.
Figure 2C:
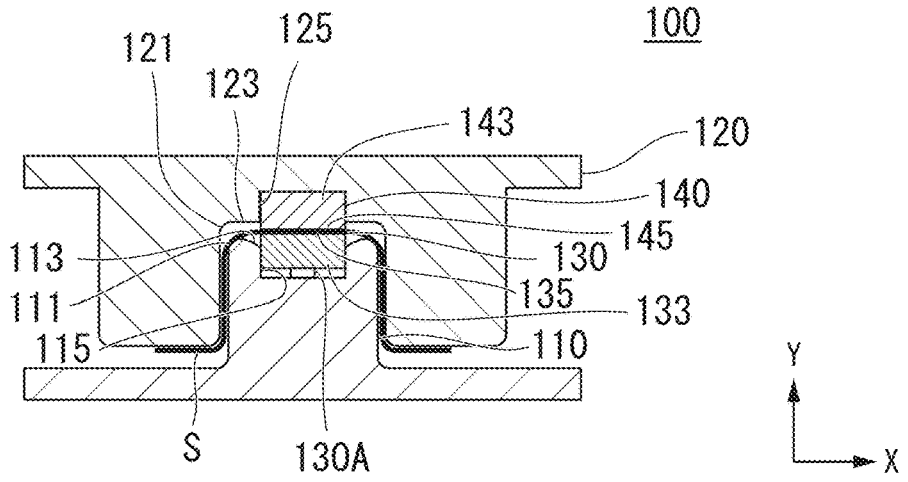
FIG. 2C is a schematic diagram for explaining the press forming method according to the first embodiment, showing a state of a later stage in which the die is lowered while the steel sheet is clamped between the die pad and the punch pad.

Next, as shown in FIGS. 2B and 2C, in a state in which the steel sheet S is clamped, the die 120 is lowered while producing a deflection in the steel sheet S between the punch shoulder portion 111 and the punch side blank holding surface 135 such that the die 120 and the punch 110 are approximated to each other. FIG. 2B shows an initial stage of lowering the die 120, whereas FIG. 2C shows a later stage of lowering the die. At a time point shown in FIG. 2C, the shaft fixing surface 143 of the die pad 140 comes into contact with an upper surface of the die pad accommodation portion 125. Accordingly, after this time point, the die pad 140 also lowers at the same lowering speed as the die 120 is lowered.

As shown in FIGS. 2A to 2C, the die pad 140 and the punch pad 130 do not move relative to the punch 110 while keeping clamping the steel sheet S, until the position of the die 120 reaches a position above a bottom dead center by an amount corresponding to the initial deflection amount at a portion of the steel sheet S to be formed into the end portion of the top sheet+a pushing amount into a more inner side of the punch 110 than the punch shoulder portion 111. The forming of the steel sheet S by the die 120 and the punch 110 progresses meantime.

(Step 3)

Figure 2D:
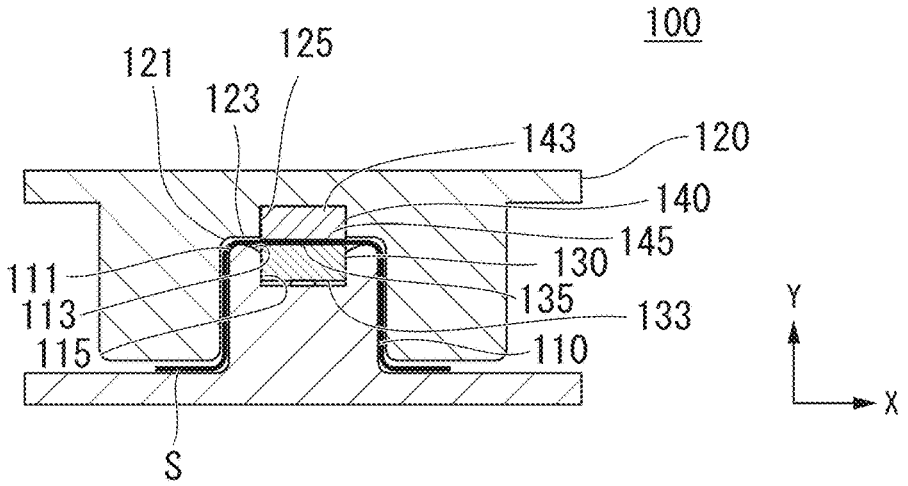
FIG. 2D is a schematic diagram for explaining the press forming method according to the first embodiment, showing a state immediately before the die and a punch come closest to each other.

FIG. 2D shows a state in which the die 120 and the die pad 140 are further lowered from the state shown in FIG. 2C to a state immediately before the die 120 and the punch 110 come closest to each other. At this time point, the height position of the punch shoulder portion 111 and the height position of an end surface of the punch side blank holding surface 135 become substantially the same. That is, a state is reached in which an initial deflection produced during the states shown in FIGS. 2B and 2C is substantially eliminated and a residual deflection (a bulging portion having a minute curvature shape) is produced between the punch shoulder portion 111 and the punch side blank holding surface 135.

(Step 4)

Figure 2E:
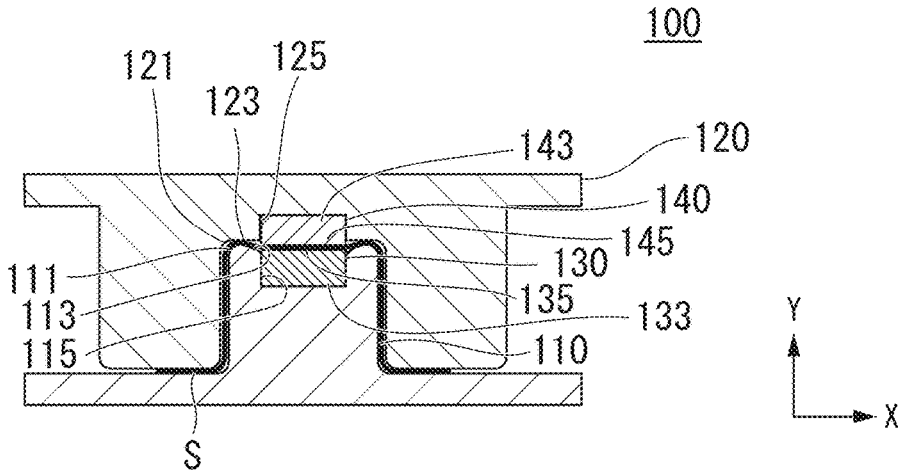
FIG. 2E is a schematic diagram for explaining the press forming method according to the first embodiment, showing a state in which the die and the punch are closest to each other.

Next, as shown in FIG. 2E, the die 120 and the die pad 140 are further lowered from the state shown in FIG. 2D such that the end surface of the punch side blank holding surface 135 adjacent to the punch shoulder portion 111 while being separated therefrom can be pushed into a more inner side of the punch 110 than the punch shoulder portion 111 by a predetermined amount (for example, 1 mm in a pressing direction).

In the press forming apparatus 100 according to the present embodiment, in a section from the punch shoulder portion 111 to an edge of the punch pad accommodation portion 115, a recess portion is formed in the punch 110 on a more inner side of the punch 110 than the punch shoulder portion 111. Therefore, when the steel sheet S is clamped between the die 120 and the punch 110, a surface of the steel sheet S on the side of the die 120 in a section between a point in contact with an end portion of the die bottom end shoulder portion 121 and a point in contact with the die pad 140 can be put into a state of non-contact with the die 120 and the die pad 140.

Figure 18:
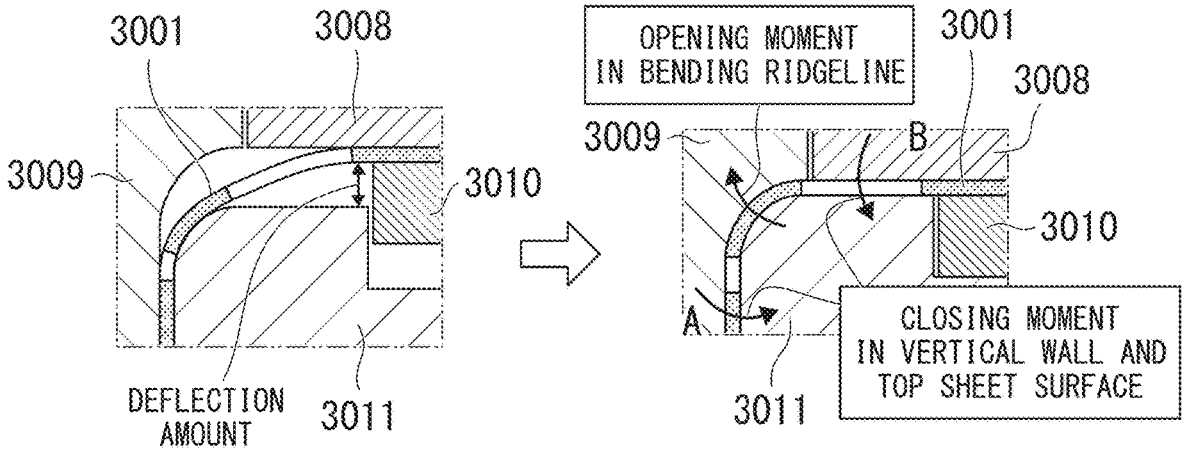
FIG. 18 is an explanatory diagram for explaining the principle of suppressing opening of a vertical wall of a press-formed article manufactured using the press forming method according to the third conventional example shown in FIGS. 17A to 17D.
Figure 19:
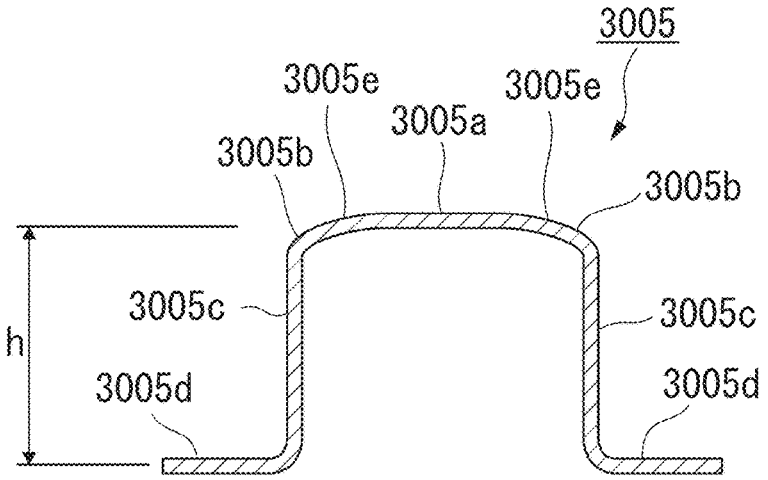
FIG. 19 is an explanatory diagram showing an example of a cross-sectional shape of the press-formed article manufactured using the press forming method according to the third conventional example shown in FIGS. 17A to 17D.

Accordingly, a region of the steel sheet S corresponding to this section is not crushed and thus, the fluctuation of a moment B at a deflection-imparted portion described with reference to FIG. 18 due to an alteration in the initial deflection amount is suppressed. It is therefore possible to control the dimensional accuracy of the press-formed article 1 only by a change in a moment A of the vertical walls 1*c* and 1*c*. In other words, the fluctuation of the closing direction moment generated in a portion to be formed into the end portion of the top sheet 1*a* can be suppressed irrespective of the initial deflection amount and the setting allowable range of the initial deflection amount can be enlarged.

Furthermore, according to the present embodiment, since the end surface of the punch side blank holding surface 135 adjacent to the punch shoulder portion 111 while being separated therefrom is moved on a more inner side of the punch 110 than the punch shoulder portion 111, it is possible to eliminate the bending tendency which inevitably occurs in the press forming method according to Patent Document 2, regardless of the extent of the degree.

Second Embodiment

A press forming method according to a second embodiment of the present invention will be described with reference to FIGS. 3A to 3D. In the present embodiment, a press-formed article 1 is manufactured by press-working a steel sheet S using a press forming apparatus 200. A steel sheet pre-worked by press forming shown in FIGS. 16A and 16B is used as the steel sheet S. FIGS. 3A to 3D are explanatory diagrams showing processes of manufacturing the press-formed article 1 from the steel sheet S with the press forming apparatus 200 with the lapse of time. Note that, in FIGS. 3A to 3D, a Y direction is a press forming direction and an X direction is a width direction.

(Press Forming Apparatus 200)

Figure 3A:
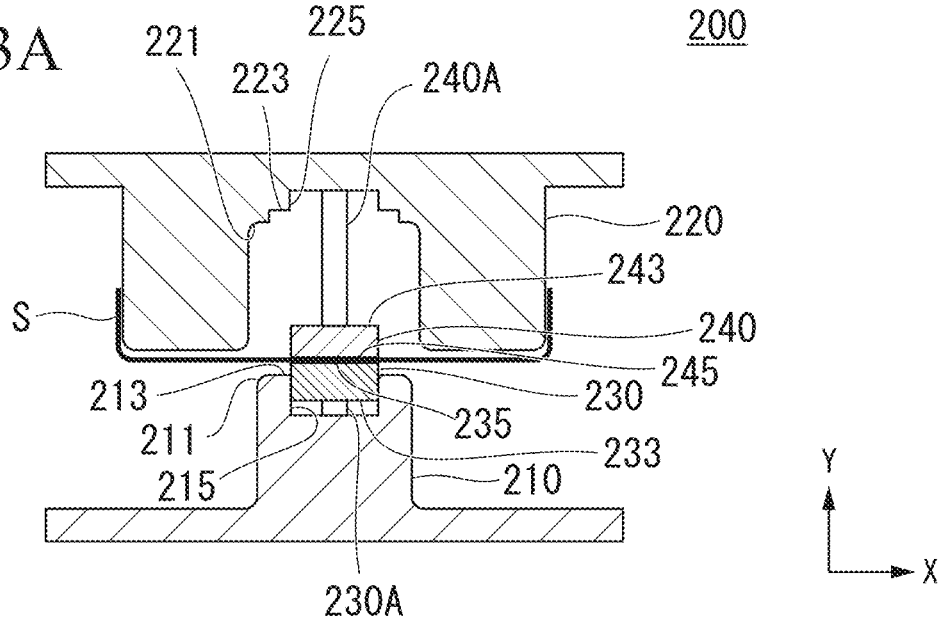
FIG. 3A is a schematic diagram for explaining a press forming method according to a second embodiment of the present invention, showing a state in which a steel sheet is clamped between a die pad and a punch pad.

As shown in FIG. 3A, the press forming apparatus 200 is constituted by a punch 210, a die 220, a punch pad 230, and a die pad 240.

(Punch 210)

The punch 210 is arranged to oppose the die 220 such that the steel sheet S is sandwiched therebetween and has a pair of punch shoulder portions 211, a punch shoulder joint portion 213, and a punch pad accommodation portion 215.

Each of the pair of punch shoulder portions 211 is a region corresponding to an R portion on an inner side surface (a surface on the side of the punch 210) of each of ridgelines 1*b* and 1*b* of the press-formed article 1.

The punch shoulder joint portion 213 is a region formed so as to connect the punch shoulder portion 211 and the punch pad accommodation portion 215 on an upper surface of the punch 210. In other words, one punch shoulder joint portion 213 is a region on the upper surface of the punch 210 obtained by excluding the punch shoulder portion 211 and the punch pad accommodation portion 215.

The punch pad accommodation portion 215 is a depression formed so as to be able to accommodate the punch pad 230 at least in a part between the pair of punch shoulder portions 211.

(Die 220)

The die 220 is arranged to oppose the punch 210 such that the steel sheet S is sandwiched therebetween and has a pair of die bottom end shoulder portions 221, a die bottom end shoulder joint portion 223, and a die pad accommodation portion 225.

Each of the die bottom end shoulder portions 221 is a region corresponding to an outer side surface (a surface on the side of the die 220) of each of the ridgelines 1*b* and 1*b* of the formed article. In the example shown in the present embodiment, the die bottom end shoulder portion 221 is formed as an R portion having a predetermined radius of curvature. However, the die bottom end shoulder portion 221 may be formed by a corner portion having a predetermined angle. In a case where the die bottom end shoulder portion 221 is formed by an R portion having a predetermined radius of curvature, the die bottom end shoulder portion 221 is a region between two R-finishes in the R portion.

The die bottom end shoulder joint portion 223 is a region formed so as to connect the die bottom end shoulder portion 221 and the die pad accommodation portion 225. In the die bottom end shoulder joint portion 223, in a section from an end portion of the die bottom end shoulder portion 221 on a die pad side to an edge of the die pad accommodation portion 225, a recess portion is formed on a more inner side of the die 220 than the die bottom end shoulder portion 221.

The die pad accommodation portion 225 is a depression formed so as to be able to accommodate the die pad 240 at least in a part between the pair of die bottom end shoulder portions 221.

(Punch Pad 230)

The punch pad 230 is arranged so as to be able to be accommodated in the punch pad accommodation portion 215 formed in the punch 210. The punch pad 230 has a shaft fixing surface 233 to which one end of a shaft 230A movable in the press forming direction is fixed and a punch side blank holding surface 235 that clamps the steel sheet S together with the die pad 240. Another end of the shaft 230A is supported by the punch 210 via a pressurizing support mechanism such as a gas cushion (not shown). Alternatively, the another end of the shaft 230A may be supported using a cushion mechanism installed on a bolster of a press machine (not shown).

(Die Pad 240)

The die pad 240 is arranged in the die pad accommodation portion 225 formed in the die 220. The die pad 240 has a shaft fixing surface 243 to which one end of a shaft 240A movable in the press forming direction is fixed and a die side blank holding surface 245 that clamps the steel sheet S together with the punch pad 230.

Another end of the shaft 240A is supported by the die 220 via a pressurizing support mechanism such as a gas cushion (not shown). Alternatively, the another end of the shaft 240A may be supported using a cushion mechanism installed on a slide of a press machine (not shown).

In the press forming method according to the present embodiment, the press-formed article 1 is manufactured from the steel sheet S using the above-described press forming apparatus 200 through the following procedures.

(Step 1)

First, as shown in FIG. 3A, the steel sheet S is clamped between the punch pad 230 and the die pad 240 at a position closer to the die 220 than the punch shoulder portion 211.

(Step 2)

Figure 3B:
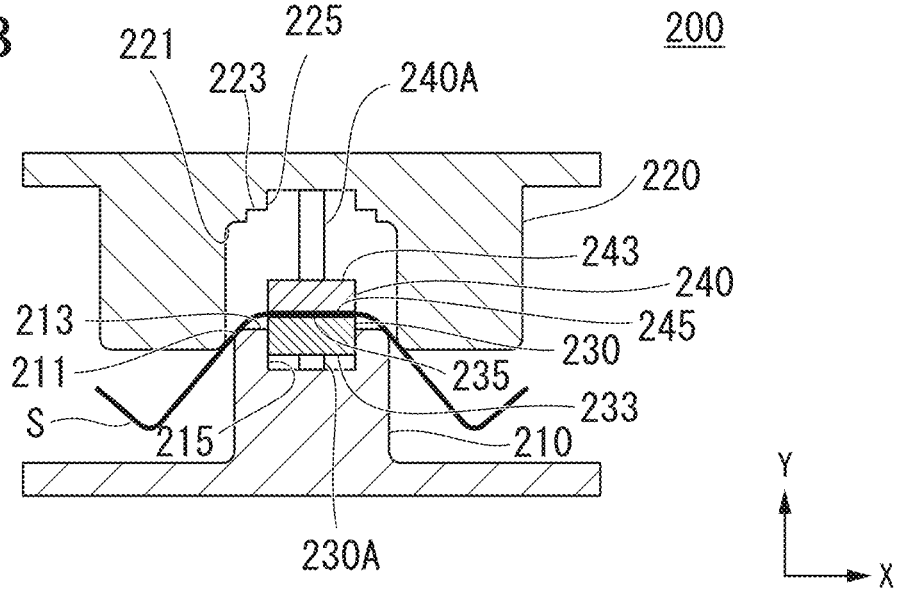
FIG. 3B is a schematic diagram for explaining the press forming method according to the second embodiment, showing a state of an initial stage in which a die is lowered while the steel sheet is clamped between the die pad and the punch pad.
Figure 3C:
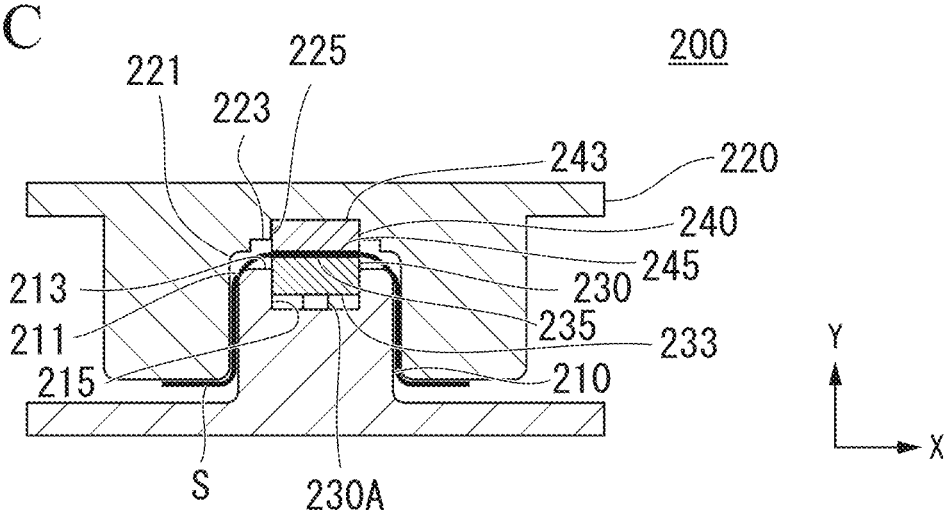
FIG. 3C is a schematic diagram for explaining the press forming method according to the second embodiment, showing a state of a later stage in which the die is lowered while the steel sheet is clamped between the die pad and the punch pad.

Next, as shown in FIGS. 3B and 3C, in a state in which the steel sheet S is clamped, the die 220 is lowered while producing a deflection in the steel sheet S between the punch shoulder portion 211 and the punch side blank holding surface 235 such that the die 220 and the punch 210 are approximated to each other. FIG. 3B shows an initial stage of lowering the die 220, whereas FIG. 3C shows a later stage of lowering the die 220. At a time point shown in FIG. 3C, the shaft fixing surface 243 of the die pad 240 comes into contact with an upper surface of the die pad accommodation portion 225. Accordingly, after this time point, the die pad 240 also lowers at the same lowering speed as the die 220 is lowered.

(Step 3)

Figure 3D:
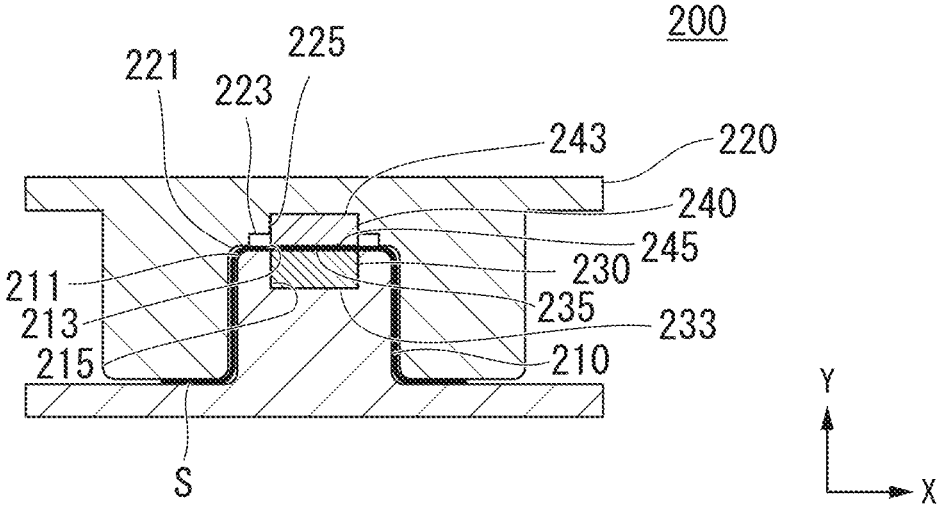
FIG. 3D is a schematic diagram for explaining the press forming method according to the second embodiment, showing a state in which the die and a punch are closest to each other.

Next, as shown in FIG. 3D, the die 220 and the die pad 240 are further lowered from the state shown in FIG. 3C to bring the die 220 and the punch 210 closest to each other. In the press forming method according to the present embodiment, the height position of the punch shoulder portion 211 and the height position of an end surface of the punch side blank holding surface 235 become substantially the same at this time point. That is, an end surface of the punch side blank holding surface 235 adjacent to the punch shoulder portion 211 while being separated therefrom become flush with the punch shoulder portion 211 (the same height). That is, a state is reached in which an initial deflection produced during the states shown in FIGS. 3B and 3C is substantially eliminated and a residual deflection (a bulging portion having a minute curvature shape) is produced between the die bottom end shoulder portion 221 and the die side blank holding surface 245.

In the press forming apparatus 200 according to the present embodiment, the die bottom end shoulder joint portion 223 of the die 220 is formed with a recess portion provided on a more inner side of the die 220 than the die bottom end shoulder portion 221 in a section from the end portion of the die bottom end shoulder portion 221 to the edge of the die pad accommodation portion 225. Therefore, when the steel sheet S is clamped between the die 220 and the punch 210, a surface of the steel sheet S on the side of the die 220 in a section between a point in contact with the die bottom end shoulder portion 221 and a point in contact with the die pad 240 can be put into a state of non-contact with the die 220 and the die pad 240.

Accordingly, a region of the steel sheet S corresponding to this section is not crushed and thus, the fluctuation of the moment B at a deflection-imparted portion described with reference to FIG. 18 due to an alteration in the initial deflection amount is suppressed. It is therefore possible to control the dimensional accuracy of the press-formed article 1 only by a change in the moment A of vertical walls 1*c* and 1*c*. In other words, the fluctuation of the closing direction moment generated in a portion to be formed into an end portion of a top sheet 1*a* can be suppressed irrespective of the initial deflection amount and the setting allowable range of the initial deflection amount can be enlarged.

Third Embodiment

A press forming method according to a third embodiment of the present invention will be described with reference to FIGS. 4A to 4E. In the present embodiment, a press-formed article 1 is manufactured by press-working a steel sheet S using a press forming apparatus 300. A steel sheet pre-worked by press forming shown in FIGS. 16A and 16B is used as the steel sheet S. FIGS. 4A to 4E are explanatory diagrams showing processes of manufacturing the press-formed article 1 from the steel sheet S with the press forming apparatus 300 with the lapse of time. Note that, in FIGS. 4A to 4E, a Y direction is a press forming direction and an X direction is a width direction.

(Press Forming Apparatus 300)

Figure 4A:
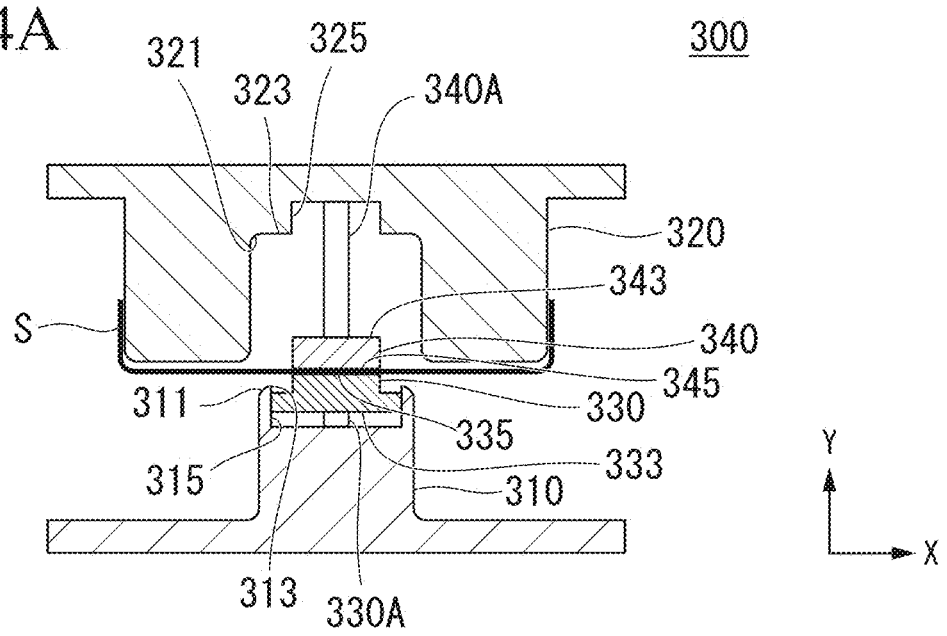
FIG. 4A is a schematic diagram for explaining a press forming method according to a third embodiment of the present invention, showing a state in which a steel sheet is clamped between a die pad and a punch pad.

As shown in FIG. 4A, the press forming apparatus 300 is constituted by a punch 310, a die 320, a punch pad 330, and a die pad 340.

(Punch 310)

The punch 310 is arranged to oppose the die 320 such that the steel sheet S is sandwiched therebetween and has a pair of punch shoulder portions 311, a punch shoulder joint portion 313, and a punch pad accommodation portion 315.

Each of the pair of punch shoulder portions 311 is a region corresponding to an R portion on an inner side surface (a surface on the side of the punch 310) of each of ridgelines 1*b* and 1*b* of the press-formed article 1.

The punch shoulder joint portion 313 is a region formed so as to connect the punch shoulder portion 311 and the punch pad accommodation portion 315 on an upper surface of the punch 310. In the present embodiment, since the punch pad accommodation portion 315 is formed with the pair of punch shoulder portions 311 as edges as described later, a tip of the punch shoulder portion 311 (an end portion which first makes contact with the steel sheet S) is regarded as the punch shoulder joint portion 313. In addition, although a tip of the punch shoulder joint portion 313 is formed in a pointed shape in the examples shown in FIGS. 4A to 4E, the tip may be rounded by providing an R portion on the side of the punch pad 330.

The punch pad accommodation portion 315 is a depression formed with the pair of punch shoulder portions 311 as edges so as to be able to accommodate the punch pad 330.

(Die 320)

The die 320 is arranged to oppose the punch 310 such that the steel sheet S is sandwiched therebetween and has a pair of die bottom end shoulder portions 321, a die bottom end shoulder joint portion 323, and a die pad accommodation portion 325.

Each of the die bottom end shoulder portions 321 is a region corresponding to an outer side surface (a surface on the side of the die 320) of each of the ridgelines 1*b* and 1*b* of the formed article.

In the example shown in the present embodiment, the die bottom end shoulder portion 321 is formed as an R portion having a predetermined radius of curvature. However, the die bottom end shoulder portion 321 may be formed by a corner portion having a predetermined angle. In a case where the die bottom end shoulder portion 321 is formed by an R portion having a predetermined radius of curvature, the die bottom end shoulder portion 321 is a region between two R-finishes in the R portion.

The die bottom end shoulder joint portion 323 is a region formed so as to connect the die bottom end shoulder portion 321 and the die pad accommodation portion 325.

The die pad accommodation portion 325 is a depression formed so as to be able to accommodate the die pad 340 at least in a part between the pair of die bottom end shoulder portions 321.

(Punch Pad 330)

The punch pad 330 is arranged so as to be able to be accommodated in the punch pad accommodation portion 315 formed in the punch 310. The punch pad 330 has a shalt fixing surface 333 to which one end of a shaft 330A movable in the press forming direction is fixed and a punch side blank holding surface 335 that clamps the steel sheet S together with the die pad 340. Another end of the shaft 330A is supported by the punch 310 via a pressurizing support mechanism such as a gas cushion (not shown). Alternatively, the another end of the shaft 330A may be supported using a cushion mechanism installed on a bolster of a press machine (not shown).

In addition, while the shaft fixing surface 333 is in contact with a bottom surface of the punch pad accommodation portion 315, the punch side blank holding surface 335 is located at a position lower than the punch shoulder portion 311.

The width of the punch side blank holding surface 335 is set to be narrower than the width of the punch pad accommodation portion 315. That is, the punch pad 330 in the present embodiment has a convex shape protruding toward the side of the die 320.

Additionally, an end portion of the punch side blank holding surface 335 is located at the same position as an end portion of the die side blank holding surface 345 described later on a plane perpendicular to the pressing direction.

(Die Pad 340)

The die pad 340 is arranged in the die pad accommodation portion 325 formed in the die 320. The die pad 340 has a shaft fixing surface 343 to which one end of a shaft 340A movable in the press forming direction is fixed and a die side blank holding surface 345 that clamps the steel sheet S together with the punch pad 330.

Another end of the shaft 340A is supported by the die 320 via a pressurizing support mechanism such as a gas cushion (not shown). Alternatively, the another end of the shaft 340A may be supported using a cushion mechanism installed on a slide of a press machine (not shown).

In the press forming method according to the present embodiment, the press-formed article 1 is manufactured from the steel sheet S using the above-described press forming apparatus 300 through the following procedures.

(Step 1)

First, as shown in FIG. 4A, the steel sheet S is clamped between the punch pad 330 and the die pad 340 at a position closer to the die 320 than the punch shoulder portion 311.

(Step 2)

Figure 4B:
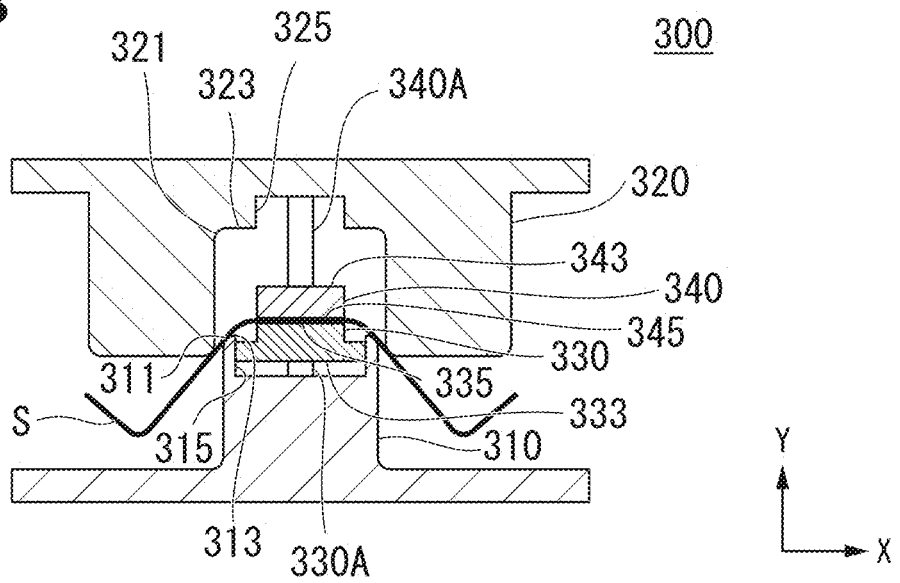
FIG. 4B is a schematic diagram for explaining the press forming method according to the third embodiment, showing a state of an initial stage in which a die is lowered while the steel sheet is clamped between the die pad and the punch pad.
Figure 4C:
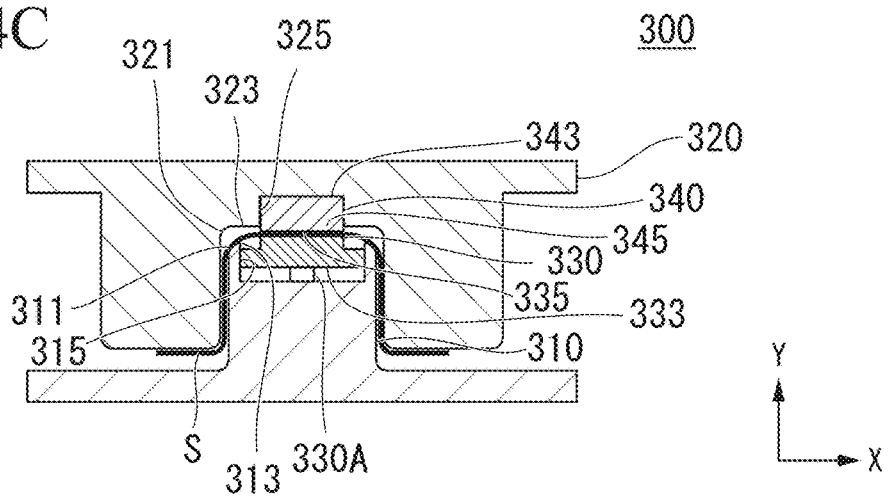
FIG. 4C is a schematic diagram for explaining the press forming method according to the third embodiment, showing a state of a later stage in which the die is lowered while the steel sheet is clamped between the die pad and the punch pad.

Next, as shown in FIGS. 4B and 4C, in a state in which the steel sheet S is clamped, the die 320 is lowered while producing a deflection in the steel sheet S between the punch shoulder portion 311 and the punch side blank holding surface 335 such that the die 320 and the punch 310 are approximated to each other. FIG. 4B shows an initial stage of lowering the die 320, whereas FIG. 4C shows a later stage of lowering the die 320. At a time point shown in FIG. 4C, the shaft fixing surface 343 of the die pad 340 comes into contact with an upper surface of the die pad accommodation portion 325. Accordingly, after this time point, the die pad 340 also lowers at the same lowering speed as the die 320 is lowered.

(Step 3)

Figure 4D:
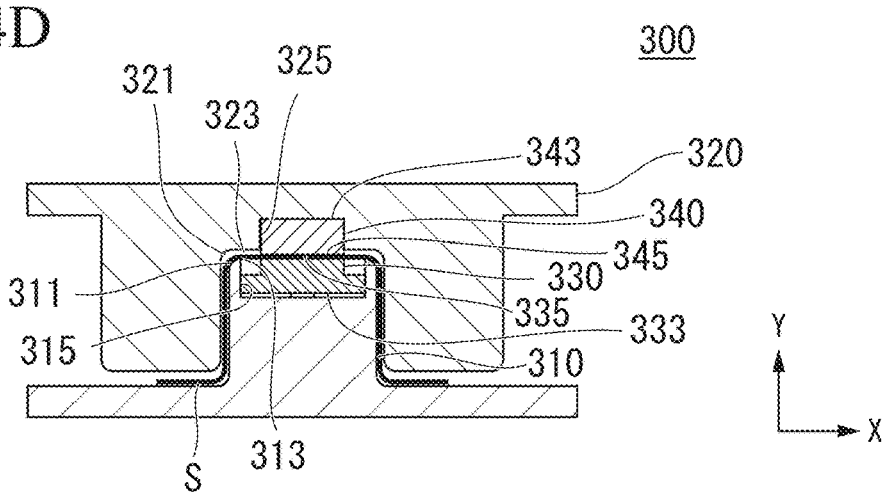
FIG. 4D is a schematic diagram for explaining the press forming method according to the third embodiment, showing a state immediately before the die and a punch come closest to each other.

FIG. 4D shows a state in which the die 320 and the die pad 340 are further lowered from the state shown in FIG. 4C to a state immediately before the die 320 and the punch 310 come closest to each other. At this time point, the height position of the punch shoulder portion 311 and the height position of an end surface of the punch side blank holding surface 335 become substantially the same. That is, a state is reached in which an initial deflection produced during the states shown in FIGS. 4B and 4C is substantially eliminated and a residual deflection (a bulging portion having a minute curvature shape) is produced between the punch shoulder portion 311 and the punch side blank holding surface 335.

(Step 4)

Figure 4E:
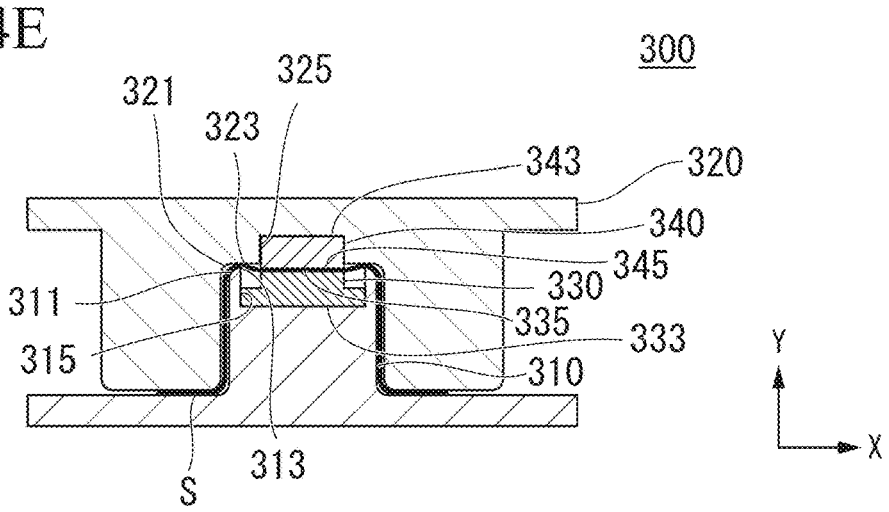
FIG. 4E is a schematic diagram for explaining the press forming method according to the third embodiment, showing a state in which the die and the punch are closest to each other.

Next, as shown in FIG. 4E, the die 320 and the die pad 340 are further lowered from the state shown in FIG. 4D such that the end surface of the punch side blank holding surface 335 adjacent to the punch shoulder portion 311 while being separated therefrom can be pushed into a more inner side of the punch 310 than the punch shoulder portion 311 by a predetermined amount (for example, 1 mm in the pressing direction).

That is, the end surface of the punch side blank holding surface 335 adjacent to the punch shoulder portion 311 while being separated therefrom is moved on a more inner side of the punch 310 than the punch shoulder portion 311.

In the press forming apparatus 300 according to the present embodiment, the punch pad accommodation portion 315 is provided in the punch 310 with the punch shoulder portion 311 as an edge, the width of the punch side blank holding surface 335 is narrower than the width of the punch pad accommodation portion 315, and the end portion of the punch side blank holding surface 335 is located at the same position as the end portion of the die side blank holding surface 345 on the plane perpendicular to the pressing direction. In other words, when the steel sheet S is clamped between the die 320 and the punch 310, a surface of the steel sheet S on the side of the die 320 in a section between a point in contact with an end portion of the die bottom end shoulder portion 321 and a point in contact with the die pad 340 can be put into a state of non-contact with the die 320 and the die pad 340.

Accordingly, a region of the steel sheet S corresponding to this section is not crushed and thus, the fluctuation of a moment B at a deflection-imparted portion described with reference to FIG. 18 due to an alteration in the initial deflection amount is suppressed. It is therefore possible to control the dimensional accuracy of the press-formed article 1 only by a change in a moment A of the vertical walls 1*c* and 1*c*. In other words, the fluctuation of the closing direction moment generated in a portion to be formed into the end portion of the top sheet 1*a* can be suppressed irrespective of the initial deflection amount and the setting allowable range of the initial deflection amount can be enlarged.

Furthermore, according to the present embodiment, since the end surface of the punch side blank holding surface 335 adjacent to the punch shoulder portion 311 while being separated therefrom is moved on a more inner side of the punch 310 than the punch shoulder portion 311, it is possible to eliminate the bending tendency which inevitably occurs in the press forming method according to Patent Document 2.

In addition, in the present embodiment, since the punch pad accommodation portion 315 is formed with the pair of punch shoulder portions 311 as edges, it is desirable to apply the present embodiment to a press forming apparatus having a thickness of the punch shoulder portion 311 that can ensure the strength thereof, that is, having a large R shape of the punch shoulder portion 311. The large R shape has, for example, a radius of 10 mm or more.

Fourth Embodiment

A press forming method according to a fourth embodiment of the present invention will be described with reference to FIGS. 5A to 5E. In the present embodiment, a press-formed article 1 is manufactured by press-working a steel sheet S using a press forming apparatus 400. A steel sheet pre-worked by press forming shown in FIGS. 16A and 16B is used as the steel sheet S. FIGS. 5A to 5E are explanatory diagrams showing processes of manufacturing the press-formed article 1 from the steel sheet S with the press forming apparatus 400 with the lapse of time. Note that, in FIGS. 5A to 5E, a Y direction is a press forming direction and an X direction is a width direction.

(Press Forming Apparatus 400)

Figure 5A:
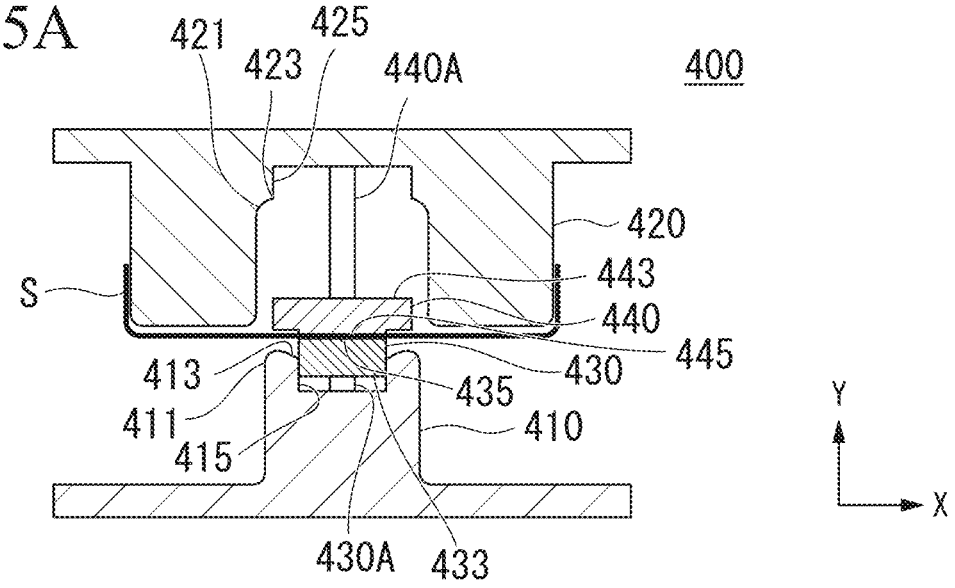
FIG. 5A is a schematic diagram for explaining a press forming method according to a fourth embodiment of the present invention, showing a state in which a steel sheet is clamped between a die pad and a punch pad.

As shown in FIG. 5A, the press forming apparatus 400 is constituted by a punch 410, a die 420, a punch pad 430, and a die pad 440.

(Punch 410)

The punch 410 is arranged to oppose the die 420 such that the steel sheet S is sandwiched therebetween and has a pair of punch shoulder portions 411, a punch shoulder joint portion 413, and a punch pad accommodation portion 415.

Each of the pair of punch shoulder portions 411 is a region corresponding to an R portion on an inner side surface (a surface on the side of the punch 410) of each of ridgelines 1*b* and 1*b* of the press-formed article 1.

The punch shoulder joint portion 413 is a region formed so as to connect the punch shoulder portion 411 and the punch pad accommodation portion 415 on an upper surface of the punch 410. In other words, one punch shoulder joint portion 413 is a region on the upper surface of the punch 410 obtained by excluding the punch shoulder portion 411 and the punch pad accommodation portion 415. In the present embodiment, the punch shoulder joint portion 413 has a shape recessed from the punch shoulder portion 411 through the punch pad accommodation portion 415.

The punch pad accommodation portion 415 is a depression formed so as to be able to accommodate the punch pad 430 at least in a part between the pair of punch shoulder portions 411.

(Die 420)

The die 420 is arranged to oppose the punch 410 such that the steel sheet S is sandwiched therebetween and has a pair of die bottom end shoulder portions 421, a die bottom end shoulder joint portion 423, and a die pad accommodation portion 425.

Each of the die bottom end shoulder portions 421 is a region corresponding to an outer side surface (a surface on the side of the die 420) of each of the ridgelines 1*b* and 1*b* of the formed article. In the example shown in the present embodiment, the die bottom end shoulder portion 421 is formed as an R portion having a predetermined radius of curvature. However, the die bottom end shoulder portion 421 may be formed by a corner portion having a predetermined angle. In a case where the die bottom end shoulder portion 421 is formed by an R portion having a predetermined radius of curvature, the die bottom end shoulder portion 421 is a region between two R-finishes in the R portion.

The die bottom end shoulder joint portion 423 is a region formed so as to connect the die bottom end shoulder portion 421 and the die pad accommodation portion 425. In the present embodiment, since the die pad accommodation portion 425 is formed with the pair of die bottom end shoulder portions 421 as edges as described later, an end portion of the die bottom end shoulder portion 421 (boundary portion with the die pad accommodation portion 425) is regarded as the die bottom end shoulder joint portion 423.

The die pad accommodation portion 425 is a depression formed with the pair of die bottom end shoulder portions 421 as edges so as to be able to accommodate the die pad 440.

(Punch Pad 430)

The punch pad 430 is arranged in the punch pad accommodation portion 415 formed in the punch 410. The punch pad 430 has a shaft fixing surface 433 to which one end of a shaft 430A movable in the press forming direction is fixed and a punch side blank holding surface 435 that clamps the steel sheet S together with the die pad 440. Another end of the shaft 430A is supported by the punch 410 via a pressurizing support mechanism such as a gas cushion (not shown). Alternatively, the another end of the shaft 430A may be supported using a cushion mechanism installed on a bolster of a press machine (not shown).

In addition, while the shaft fixing surface 433 is in contact with a bottom surface of the punch pad accommodation portion 415, the punch side blank holding surface 435 is located at a position lower than the punch shoulder portion 411.

(Die Pad 440)

The die pad 440 is arranged in the die pad accommodation portion 425 formed in the die 420. The die pad 440 has a shaft fixing surface 443 to which one end of a shaft 440A movable in the press forming direction is fixed and a die side blank holding surface 445 that clamps the steel sheet S together with the punch pad 430.

Another end of the shaft 440A is supported by the die 420 via a pressurizing support mechanism such as a gas cushion (not shown). Alternatively, the another end of the shaft 440A may be supported using a cushion mechanism installed on a slide of a press machine (not shown).

The width of the die side blank holding surface 445 is set to be narrower than the width of the die pad accommodation portion 425. That is, the die pad 440 in the present embodiment has a convex shape protruding toward the side of the punch 410.

In addition, an end portion of the die side blank holding surface 445 is located at the same position as an end portion of the punch side blank holding surface 435 on a plane perpendicular to the pressing direction.

In the press forming method according to the present embodiment, the press-formed article 1 is manufactured from the steel sheet S using the above-described press forming apparatus 400 through the following procedures.

(Step 1)

First, as shown in FIG. 5A, the steel sheet S is clamped between the punch pad 430 and the die pad 440 at a position closer to the die 420 than the punch shoulder portion 411.

(Step 2)

Figure 5B:
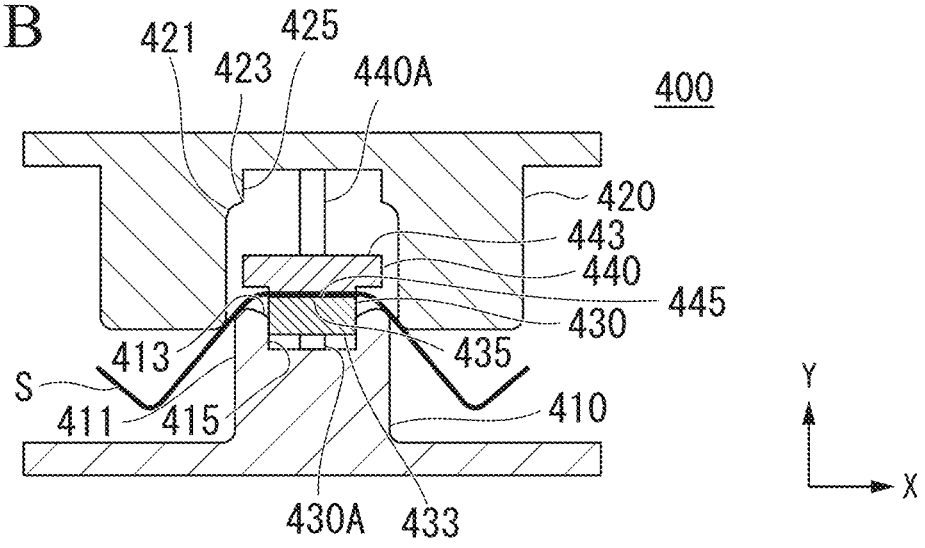
FIG. 5B is a schematic diagram for explaining the press forming method according to the fourth embodiment, showing a state of an initial stage in which a die is lowered while the steel sheet is clamped between the die pad and the punch pad.
Figure 5C:
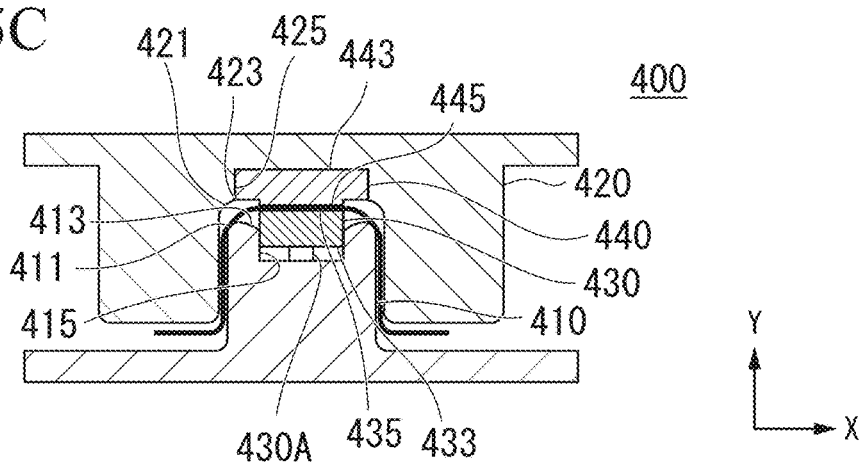
FIG. 5C is a schematic diagram for explaining the press forming method according to the fourth embodiment, showing a state of a later stage in which the die is lowered while the steel sheet is clamped between the die pad and the punch pad.

Next, as shown in FIGS. 5B and 5C, in a state in which the steel sheet S is clamped, the die 420 is lowered while producing a deflection in the steel sheet S between the punch shoulder portion 411 and the punch side blank holding surface 435 such that the die 420 and the punch 410 are approximated to each other. FIG. 5B shows an initial stage of lowering the die 420, whereas FIG. 5C shows a later stage of lowering the die 420. At a time point shown in FIG. 5C, the shaft fixing surface 443 of the die pad 440 comes into contact with an upper surface of the die pad accommodation portion 425. Accordingly, after this time point, the die pad 440 also lowers at the same lowering speed as the die 420 is lowered.

(Step 3)

Figure 5D:
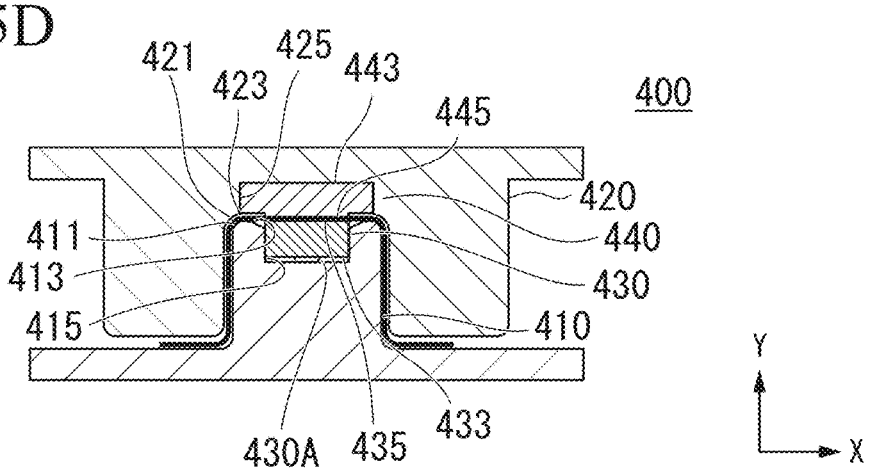
FIG. 5D is a schematic diagram for explaining the press forming method according to the fourth embodiment, showing a state immediately before the die and a punch come closest to each other.

FIG. 5D shows a state in which the die 420 and the die pad 440 are further lowered from the state shown in FIG. 5C to a state immediately before the die 420 and the punch 410 come closest to each other. At this time point, the height position of the punch shoulder portion 411 and the height position of an end surface of the punch side blank holding surface 435 become substantially the same. That is, a state is reached in which an initial deflection produced during the states shown in FIGS. 5B and 5C is substantially eliminated and a residual deflection (a bulging portion having a minute curvature shape) is produced between the punch shoulder portion 411 and the punch side blank holding surface 435.

(Step 4)

Figure 5E:
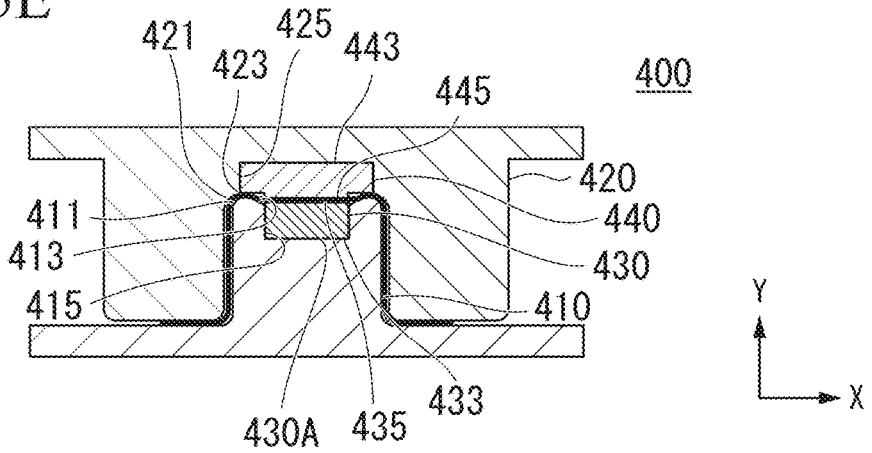
FIG. 5E is a schematic diagram for explaining the press forming method according to the fourth embodiment, showing a state in which the die and the punch are closest to each other.

Next, as shown in FIG. 5E, the die 420 and the die pad 440 are further lowered from the state shown in FIG. 5D such that the end surface of the punch side blank holding surface 435 adjacent to the punch shoulder portion 411 while being separated therefrom can be pushed into a more inner side of the punch 410 than the punch shoulder portion 411 by a predetermined amount (for example, 1 mm in the pressing direction).

That is, the end surface of the punch side blank holding surface 435 adjacent to the punch shoulder portion 411 while being separated therefrom is moved on a more inner side of the punch 410 than the punch shoulder portion 411.

In the press forming apparatus 400 according to the present embodiment, the die pad accommodation portion 425 is provided in the die 420 with an end of the die bottom end shoulder portion 421 as an edge, the width of the die side blank holding surface 445 is narrower than the width of the die pad accommodation portion 425, and the end portion of the die side blank holding surface 445 is located at the same position as the end portion of the punch side blank holding surface 435 on the plane perpendicular to the pressing direction. Therefore, when the steel sheet S is clamped between the die 420 and the punch 410, a surface of the steel sheet S on the side of the die 420 in a section between a point in contact with the end portion of the die bottom end shoulder portion 421 and a point in contact with the die side blank holding surface 445 of the die pad 440 can be put into a state of non-contact with the die 420 and the die pad 440.

Accordingly, a region of the steel sheet S corresponding to this section is not crushed and thus, the fluctuation of a moment B at a deflection-imparted portion described with reference to FIG. 18 due to an alteration in the initial deflection amount is suppressed. It is therefore possible to control the dimensional accuracy of the press-formed article 1 only by a change in a moment A of the vertical walls 1*c* and 1*c*. In other words, the fluctuation of the closing direction moment generated in a portion to be formed into the end portion of the top sheet 1*a* can be suppressed irrespective of the initial deflection amount and the setting allowable range of the initial deflection amount can be enlarged.

Furthermore, according to the present embodiment, since the end surface of the punch side blank holding surface 435 adjacent to the punch shoulder portion 411 while being separated therefrom is moved on a more inner side of the punch 410 than the punch shoulder portion 411, it is possible to eliminate the bending tendency which inevitably occurs in the press forming method according to Patent Document 2.

As described above, according to the press forming methods according to the first to fourth embodiments of the present invention, in a case where a press-formed article is manufactured from a workpiece sheet using a press forming apparatus including: a punch formed with a punch shoulder portion, a punch shoulder joint portion, and a punch pad accommodation portion; a die arranged to oppose the punch and formed with a die bottom end shoulder portion having a shape corresponding to the punch shoulder portion, a die bottom end shoulder joint portion, and a die pad accommodation portion provided in the die bottom end shoulder joint portion; a punch pad arranged in the punch pad accommodation portion and formed with a punch side blank holding surface; and a die pad arranged in the die pad accommodation portion and formed with a die side blank holding surface, when the workpiece sheet is clamped between the die and the punch, a surface of the workpiece sheet on a die side in a section between a point in contact with the die bottom end shoulder portion and a point in contact with the die side blank holding surface of the die pad is in non-contact with the die and the die pad, and an end surface of the punch side blank holding surface adjacent to the punch shoulder portion can be flush with the punch shoulder portion or located on a more inner side of the punch than the punch shoulder portion.

Therefore, the fluctuation of the closing direction moment generated in a portion to be formed into a top sheet of the workpiece sheet can be suppressed irrespective of the initial deflection amount and the setting allowable range of the initial deflection amount can be widened.

In addition, as in the first embodiment, the third embodiment, and the fourth embodiment, in a case where an end surface of the punch side blank holding surface adjacent to the punch shoulder portion while being separated therefrom is configured to be located on a more inner side of the punch than the punch shoulder portion, it is possible to eliminate the bending tendency which inevitably occurs in the conventional technology (Patent Document 2).

Meanwhile, in the case of using press forming methods according to a first modification and a second modification described below, by realizing pushing into the punch side while imparting tension to a portion of the steel sheet to be formed into the end portion of the top sheet 1*a*, a residual deflection at the end portion of the top sheet 1*a* can be reduced and the dimensional accuracy of the top sheet 1*a* can be further enhanced.

(First Modification)

A press forming method according to a first modification of the present invention will be described with reference to FIGS. 6A to 6E.

FIGS. 6A to 6E are explanatory diagrams showing processes of manufacturing a press-formed article from a steel sheet S with a press forming apparatus 100' with the lapse of time.

The present embodiment uses a press forming apparatus 100' obtained by replacing the die 120 with a die 120' in the press forming apparatus 100 described in the first embodiment.

The die 120' is constituted by a die main body 120A, a die holder 120B that supports the die main body 120A, a pressurizing support mechanism 120C provided between the die main body 120A and the die holder 120B to pressurize the die main body 120A toward the steel sheet S. Note that the pressurizing support mechanism 120C can be a spring, a gas cushion, or the like.

Since a punch, a punch pad, and a die pad are basically the same as those in the press forming apparatus 100 described in the first embodiment, the same reference symbols will be attached thereto and the detailed description thereof will be omitted.

Figure 6A:
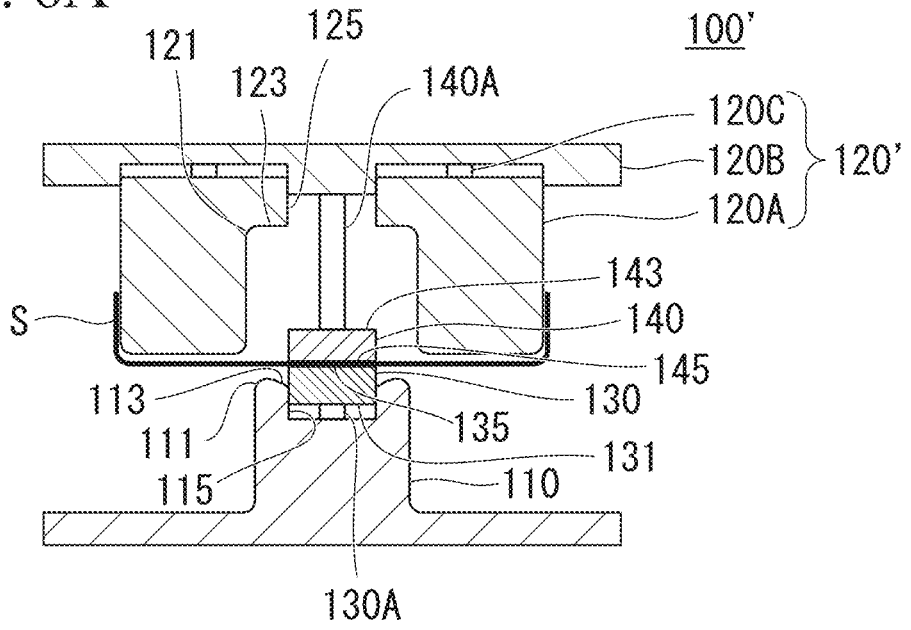
FIG. 6A is a schematic diagram for explaining a press forming method according to a first modification of the present invention, showing a state in which a steel sheet is clamped between a die pad and a punch pad.
Figure 6B:
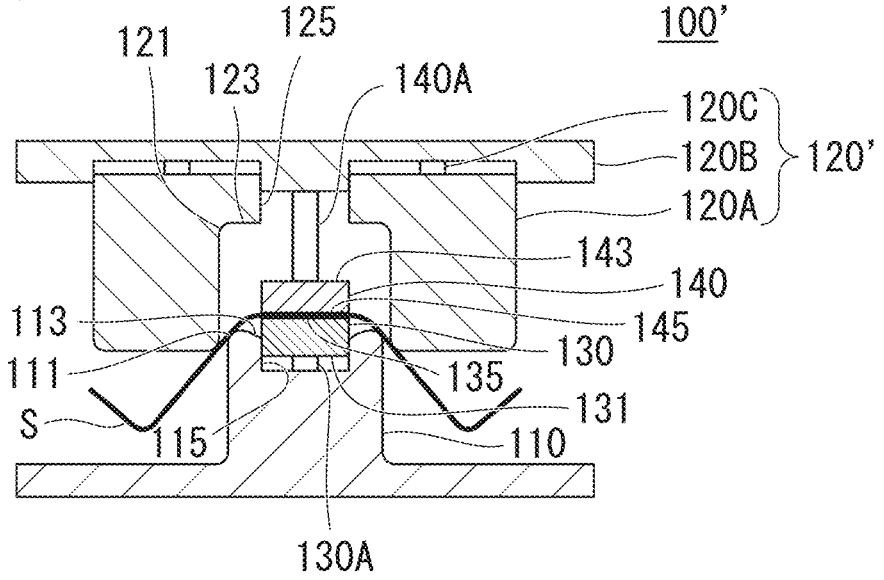
FIG. 6B is a schematic diagram for explaining the press forming method according to the first modification, showing a state of an initial stage in which a die is lowered while the steel sheet is clamped between the die pad and the punch pad.
Figure 6C:
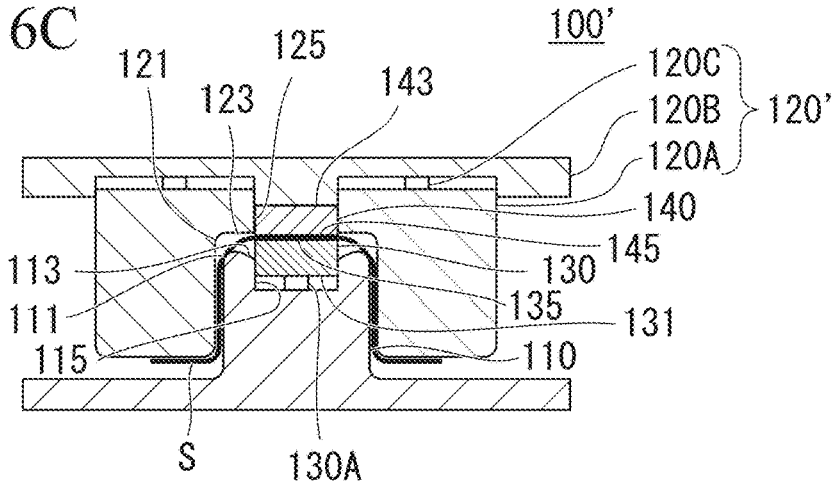
FIG. 6C is a schematic diagram for explaining the press forming method according to the first modification, showing a state of a later stage in which the die is lowered while the steel sheet is clamped between the die pad and the punch pad.
Figure 6D:
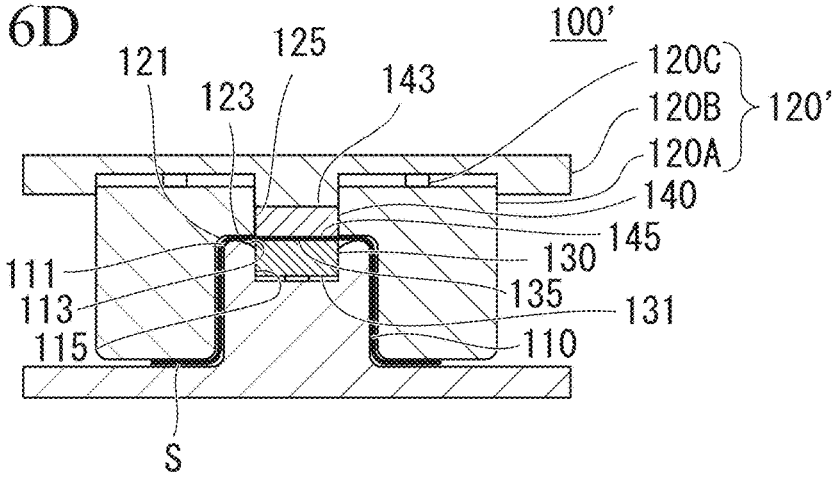
FIG. 6D is a schematic diagram for explaining the press forming method according to the first modification, showing a state in which the die and a punch are closest to each other.
Figure 6E:
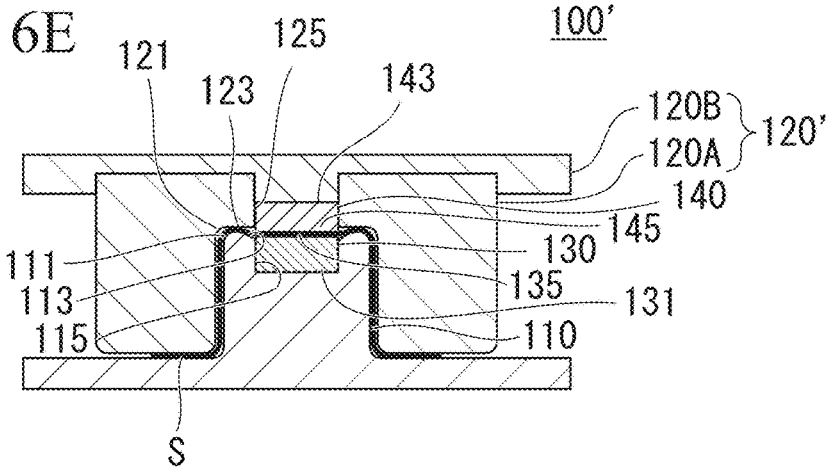
FIG. 6E is a schematic diagram for explaining the press forming method according to the first modification, showing a state in which the die pad is further pushed into a punch side from a state in which the die and the punch are closest to each other.

In the press forming method according to this first modification, the die holder 120B and the die pad 140 are further lowered, as shown in FIG. 6D, from a state in which the die main body 120A and the punch 110 are closest to each other such that a region of the steel sheet S to be formed into a top sheet 1*a* is pushed into the side of the punch 110 as shown in FIG. 6E.

According to this press forming method, pushing by the die pad 140 can be implemented while two ridgelines 1*b* and 1*b* of the steel sheet S during press forming, two vertical walls 1*c* and 1*c* continuing to the two ridgelines 1*b* and 1*b*, respectively, and flanges 1*d* and 1*d* continuing to the two vertical walls 1*c* and 1*c*, respectively, are clamped between the die main body 120A and the punch 110 such that a predetermined pressurizing force is loaded thereon.

This makes it possible to realize pushing into the punch side while tension is imparted to a portion of the steel sheet S to be formed into the end portion of the top sheet 1*a*, whereby the dimensional accuracy of the top sheet 1*a* can be further enhanced.

(Second Modification)

A press forming method according to a second modification of the present invention will be described with reference to FIGS. 7A to 7E.

FIGS. 7A to 7E are explanatory diagrams showing processes of manufacturing a press-formed article from a steel sheet S with a press forming apparatus 100" with the lapse of time.

The present embodiment uses a press forming apparatus 100" configured by adding a driving unit D that controls and drives a die pad 140 independently from a die 120 to the press forming apparatus 100 described in the first embodiment.

Since a punch, the die, a punch pad, and the die pad are basically the same as those in the press forming apparatus 100 described in the first embodiment, the same reference symbols will be attached thereto and the detailed description thereof will be omitted.

Figure 7A:
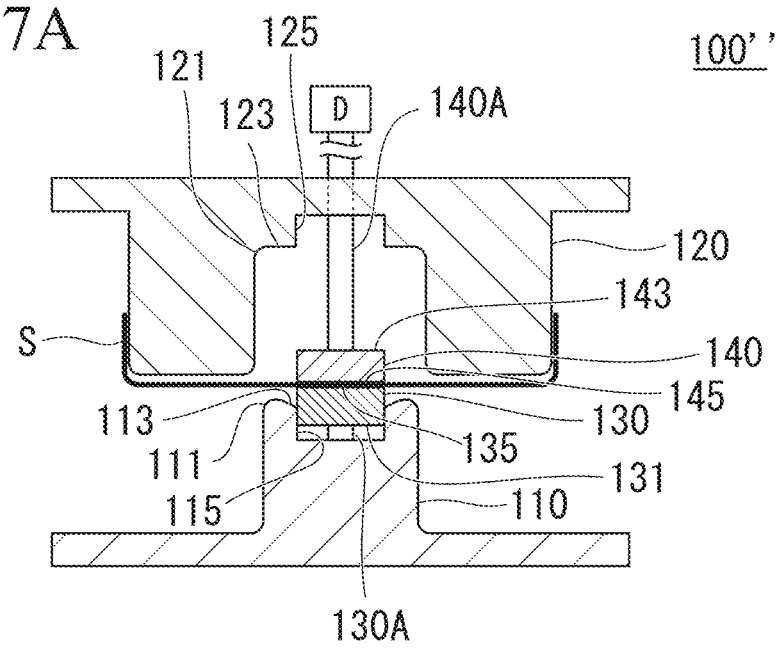
FIG. 7A is a schematic diagram for explaining a press forming method according to a second modification of the present invention, showing a state in which a steel sheet is clamped between a die pad and a punch pad.
Figure 7B:
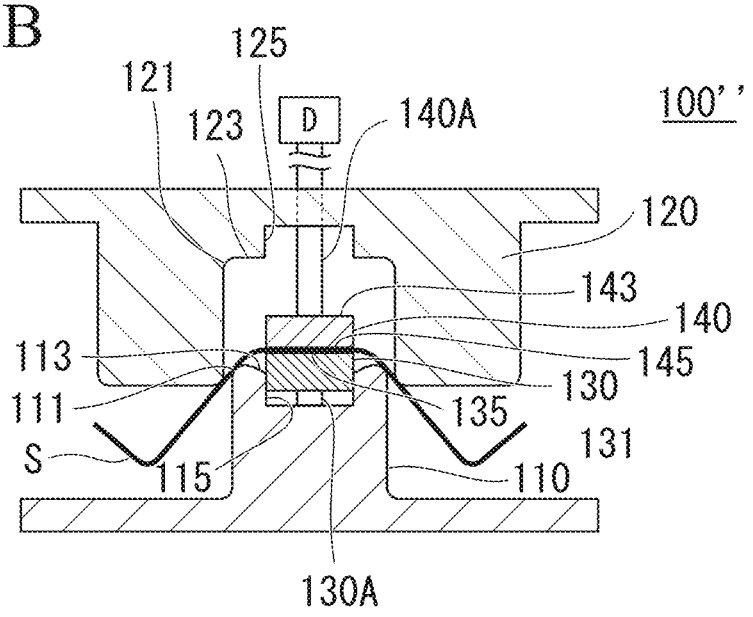
FIG. 7B is a schematic diagram for explaining the press forming method according to the second modification, showing a state of an initial stage in which a die is lowered while the steel sheet is clamped between the die pad and the punch pad.
Figure 7C:
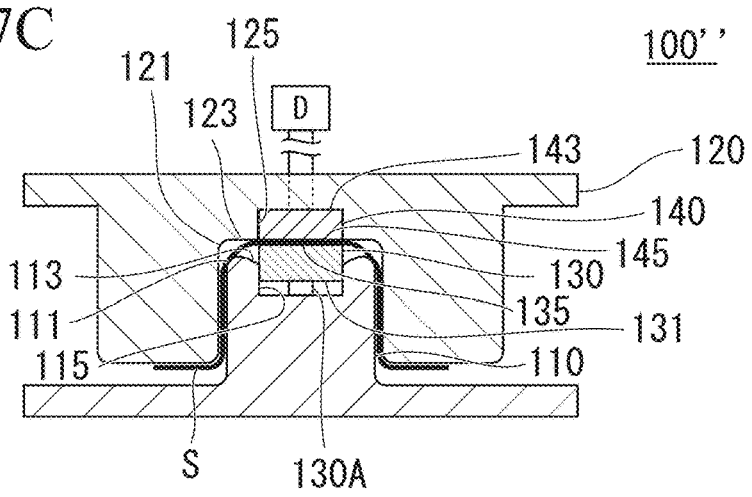
FIG. 7C is a schematic diagram for explaining the press forming method according to the second modification, showing a state of a later stage in which the die is lowered while the steel sheet is clamped between the die pad and the punch pad.
Figure 7D:
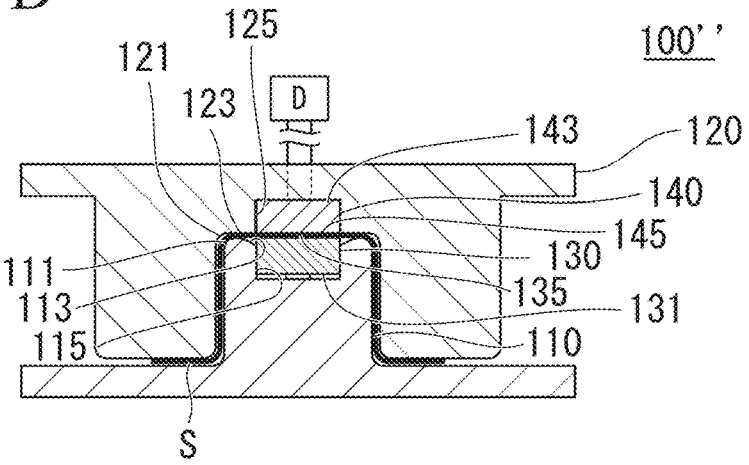
FIG. 7D is a schematic diagram for explaining the press forming method according to the second modification, showing a state in which the die and a punch are closest to each other.
Figure 7E:
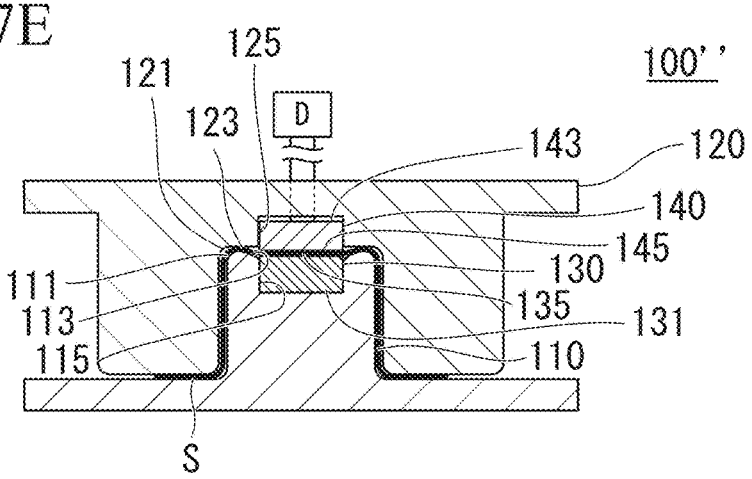
FIG. 7E is a schematic diagram for explaining the press forming method according to the second modification, showing a state in which the die pad is further pushed into a punch side from a state in which the die and the punch are closest to each other.

In the press forming method according to this second modification, the die pad 140 is further lowered by the driving unit D, as shown in FIG. 7D, from a state in which the die 120 and the punch 110 are closest to each other such that a top sheet 1*a* of the steel sheet is pushed into the side of the punch 110 as shown in FIG. 7E.

According to this press forming method, pushing by the die pad 140 can be implemented while two ridgelines 1*b* and 1*b* of the steel sheet S during press forming, two vertical walls 1*c* and 1*c* continuing to the two ridgelines 1*b* and 1*b*, respectively, and flanges 1*d* and 1*d* continuing to the two vertical walls 1*c* and 1*c*, respectively, are clamped between the die 120 and the punch 110 such that a predetermined pressurizing force is loaded thereon.

This makes it possible to realize pushing into the punch side while tension is imparted to a portion of the steel sheet S to be formed into an end portion of the top sheet 1*a*, whereby the dimensional accuracy of the top sheet 1*a* can be further enhanced.

Although specific examples of the present invention have been described on the basis of the various embodiments and modifications thus far, the present invention is not limited to these examples. The present invention includes various modifications and alterations of the specific examples mentioned above.

For example, the die 120 in the press forming apparatus 100 described in the first embodiment may be replaced with the die 220 in the press forming apparatus 200 described in the second embodiment.

In addition, for example, the punch pad 130 in the press forming apparatus 100 described in the first embodiment may be replaced with the punch pad 330 in the press forming apparatus 300 described in the third embodiment.

Similarly, the die pad 240 in the press forming apparatus 200 described in the second embodiment may be replaced with the die pad 440 in the press forming apparatus 400 described in the fourth embodiment. In this case, a region which is not in contact with a surface of the steel sheet on the die side (non-contact portion) is formed so as to straddle the die bottom end shoulder joint portion 223 of the die 220 and an end portion of the die pad 440 in the width direction.

The following modes are also included in the present invention.

In the above description, the steel sheet has been exemplified as the workpiece sheet, but a metal sheet such as an aluminum sheet or a titanium sheet, a glass fiber reinforced resin sheet made of FRP, FRTP or the like, and additionally, a composite sheet thereof can be used.

In the above description, the die is lowered, but it is also possible to raise the punch or bring both of the die and the punch closer to each other.

In the above description, both of the punch side blank holding surface and the die side blank holding surface are flat surfaces, but curved surfaces or steps may be formed.

In the above description, the press-formed article having a hat-shaped cross section is used as an object, but a press-formed article having a groove-shaped cross section or an L-shaped cross section, or a press-formed article having a hat-shaped cross section on one side may also be used as an object.

The above description has deemed the press forming as bending forming, but the object to which the present invention is applied is not necessarily limited to bending forming and the present invention can also be applied to drawing forming.

The above description has used the mode of obtaining the press-formed article by press forming the steel sheet S in which a flange has been pre-worked in advance, but the mode of obtaining the press-formed article without pre-working, that is, by one set of forming tools may be employed.

In the above description, the press working is performed by a cold press forming apparatus, but a warm or hot press forming apparatus may be used.

WORKING EXAMPLES

The present invention will be more specifically described with reference to working examples.

A first working example used the press forming apparatus 100 according to the first embodiment described with reference to FIGS. 2A to 2E, a second working example used the press forming apparatus 100' according to the first modification described with reference to FIGS. 6A to 6E, and a first comparative example used the press forming apparatus 3000 used in the third conventional example, which has been described with reference to FIGS. 17A to 17D, to perform the press forming individually.

Figure 8:
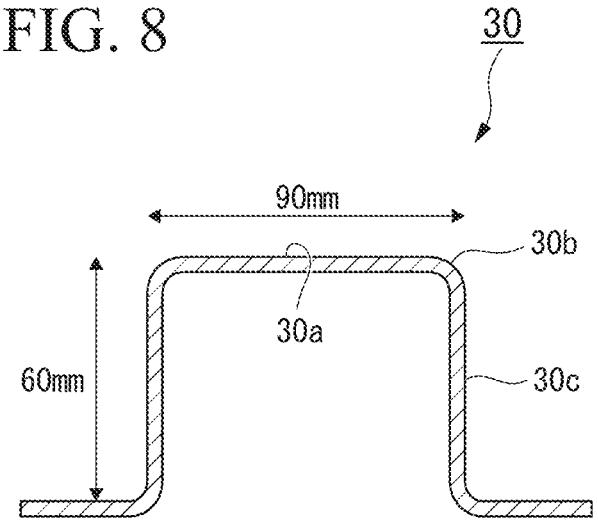
FIG. 8 is an explanatory diagram showing dimensions of a press-formed article having a hat-shaped transverse cross-sectional shape, analyzed using a working example and a comparative example.

In the first working example, the second working example, and the first comparative example, a cold-rolled steel sheet (steel sheet S) with a sheet thickness of 1.4 mm and 1180 MPa class was used as a workpiece sheet and a press-formed article 30 having a hat-shaped transverse cross-sectional shape having dimensions shown in FIG. 8 was manufactured. The press-formed article 30 has a top sheet 30*a*, a ridgeline 30*b*, and a vertical wall 30*c*.

Then, a numerical analysis was performed on the influence on a opening amount ΔY after releasing (after spring back) exerted by the initial deflection amount at a portion of the steel sheet S to be formed into the top sheet 30*a* at the time of press forming (a distance in the pressing direction between the punch shoulder portion at the start of press forming and a portion of the steel sheet S to be formed into the top sheet 30*a* at the time of press forming).

Figure 9:
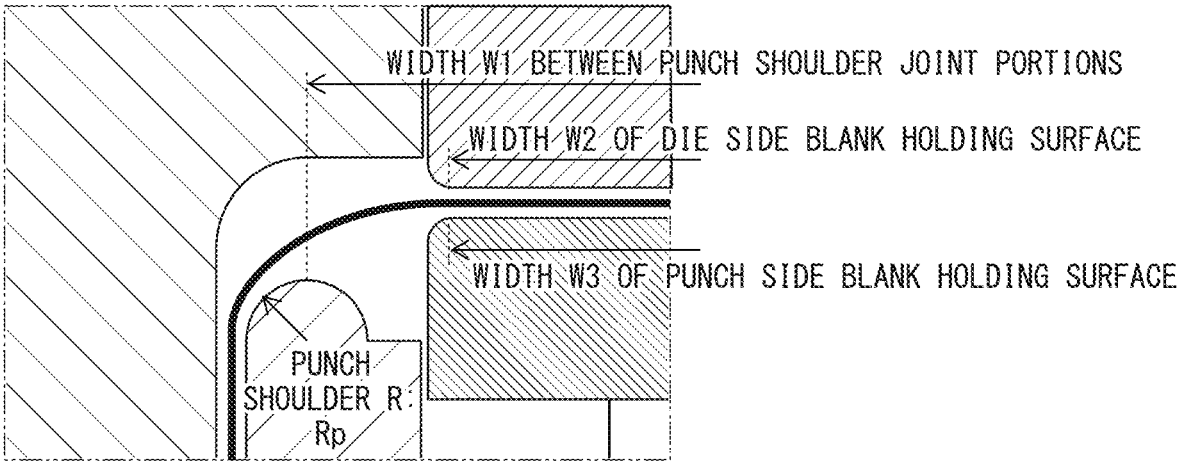
FIG. 9 is an explanatory diagram showing dimensions of respective portions of a press forming apparatus according to the present invention, analyzed using the working example.

FIG. 9 is an explanatory diagram showing dimensions of respective portions of a forming tool of the press forming apparatus 100, analyzed using the first working example.

The dimensions of respective portions of the press forming apparatus 100 shown in FIG. 9 are Rp=5 mm of a punch shoulder R, a width W1=80 mm between the punch shoulder joint portions, a width W2=56 mm of the die side blank holding surface, and a width W3=56 mm of the punch side blank holding surface.

Figure 10:
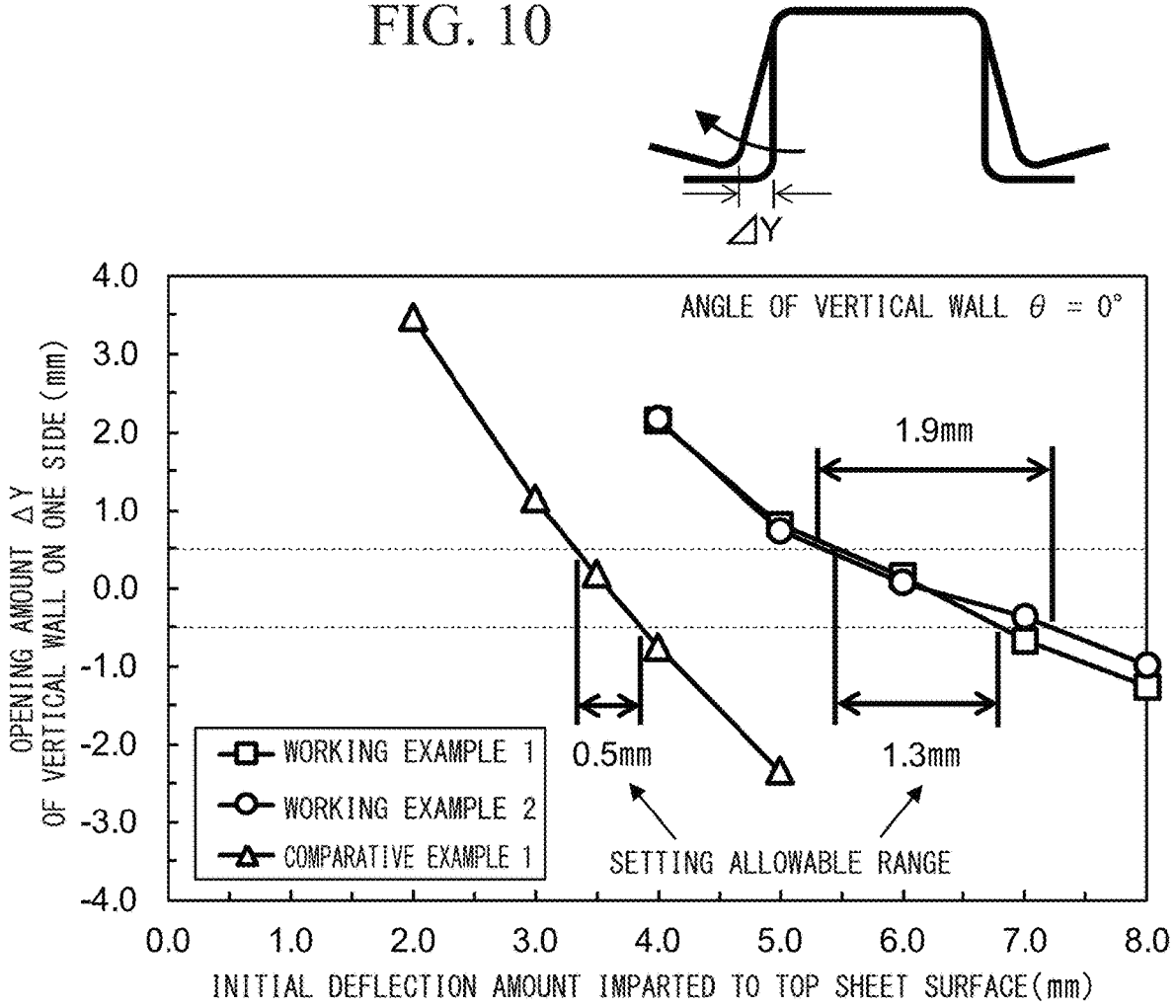
FIG. 10 is a graph showing results of numerical analysis of a first working example, a second working example, and a first comparative example.

The results are summarized in the graph in FIG. 10. In the graph in FIG. 10, respective marks represent as follows:

square marks: the first working example using the press forming apparatus 100, circular marks: the second working example using the press forming apparatus 100', and triangular marks: the first comparative example using the press forming apparatus 3000.

As shown in the graph in FIG. 10, in order to set the opening amount ΔY to a target 0.5 mm, only 0.5 mm can be ensured in the conventional example as the setting allowable range of the initial deflection amount at a portion of the steel sheet S to be formed into the end portion of the top sheet 30*a* at the time of press forming. In contrast to this, a setting allowable range of 1.3 mm is obtained in the first working example using the press forming apparatus 100, whereas a setting allowable range of 1.9 mm is obtained in the second working example using the press forming apparatus 100'. It is understood that the press forming apparatuses 100 and 100' according to the first and second working examples are superior in mass production stability to the press forming apparatus 3000 of the first comparative example and additionally, the setting allowable range of the initial deflection amount is wider and mass production stability is more excellent in the second working example than the case of the first working example.

In addition, a numerical analysis was performed on the closing direction moment of the top sheet 30*a*, the ridgeline 30*b*, and the vertical wall 30*c* of the press-formed article 30 obtained after forming in each of the second working example and the first comparative example. The analysis results are summarized in FIG. 11.

Figure 11:
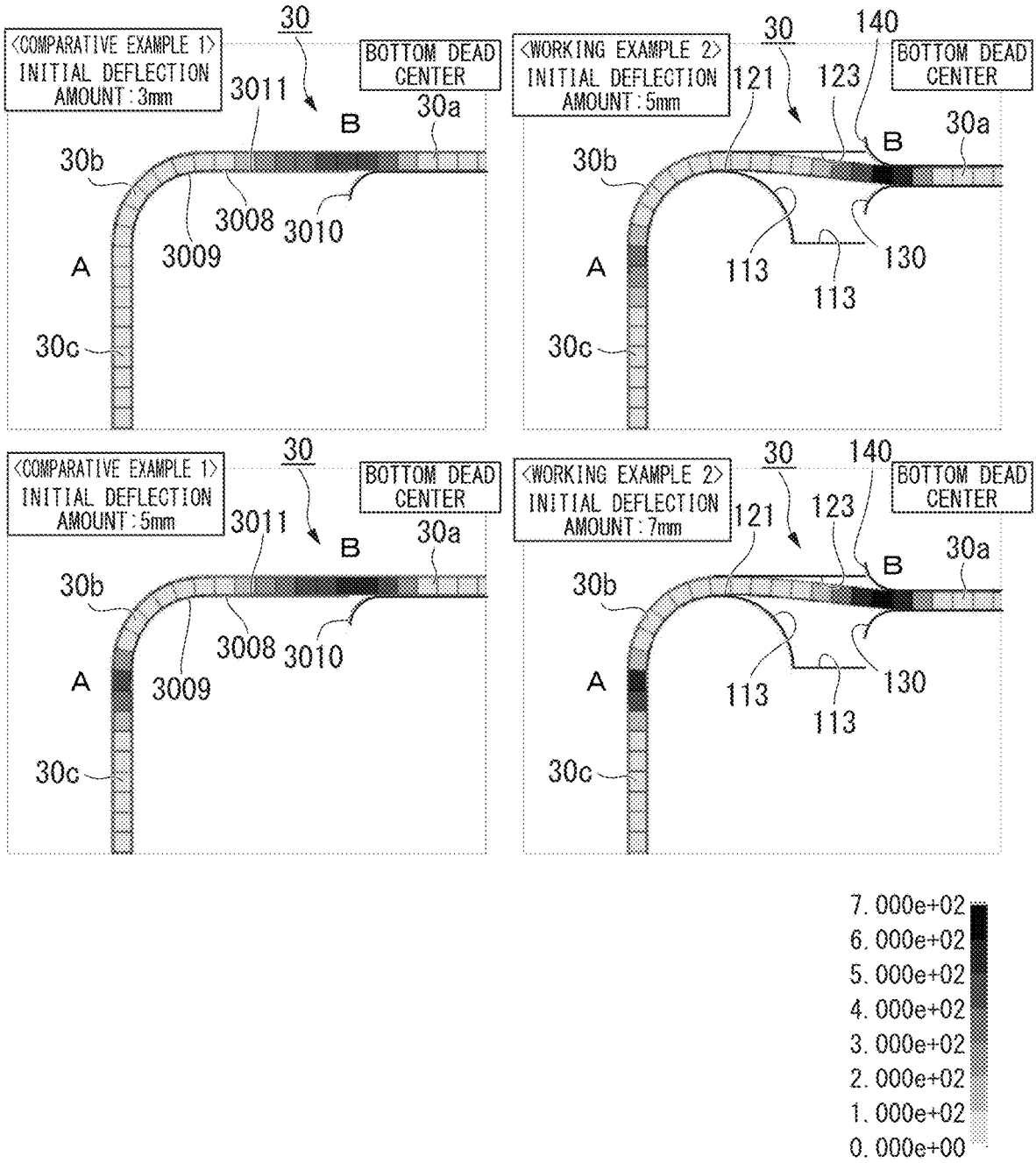
FIG. 11 is an explanatory diagram showing analysis results of the second working example and the first comparative example.

As shown in FIG. 11, in the press-formed article 30 obtained in the first comparative example, the closing direction moment largely changes in both of the regions A and B when the initial deflection amount changes to 3 mm and 5 mm. In contrast to this, in the press-formed article 30 obtained in the second working example, it is understood that the closing direction moment largely changes in the region A but a change is small in the region B when the initial deflection amount changes to 5 mm and 7 mm. That is, it is understood that the fluctuation of the moment in the region B, which affects the opening amount ΔY, is smaller in the second working example than that of the first comparative example even when the initial deflection amount changes.

Additionally, a numerical analysis was performed on the shape of the press-formed article 30 after releasing (after spring back) obtained in each of the first working example, the second working example, and the first comparative example. The analysis results are summarized in FIG. 12. Note that the initial deflection amount at the time of forming was set to the optimum value in the graph in FIG. 10, that is, 3.5 mm in the first comparative example and 6 mm in the first working example and the second working example.

Figure 12:
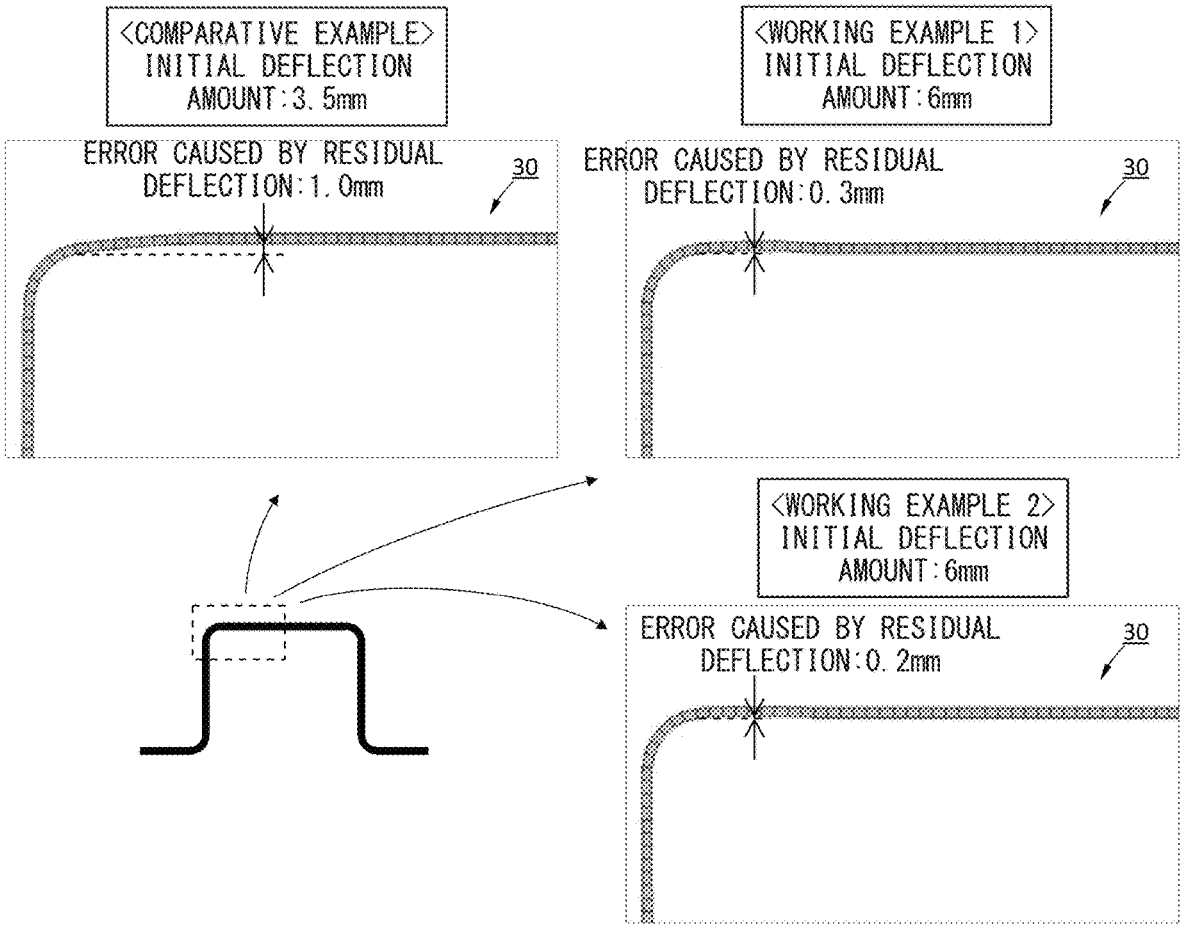
FIG. 12 is an explanatory diagram showing analysis results of the first working example, the second working example, and the first comparative example.

As shown in FIG. 12, a dimensional accuracy defect of 1.0 mm due to bending tendency (error caused by residual deflection) occurred in the first comparative example, even though it is a slight defect. However, the dimensional accuracy defect due to bending tendency (error caused by residual deflection) was 0.3 mm in the first working example, which was decreased to less than ⅓ of that of the conventional example, while the dimensional accuracy defect due to bending tendency (error caused by residual deflection) was 0.2 mm in the second working example, which was decreased to about ⅕ of that of the first comparative example. It is understood that the bending tendency has been practically eliminated.

Furthermore, a numerical analysis was performed on the closing direction moment of the top sheet 30*a*, the ridgeline 30*b*, and the vertical wall 30*c* of the press-formed article 30 obtained in each of the first working example and the second working example. The analysis results are summarized in FIGS. 13 and 14.

Figure 13:
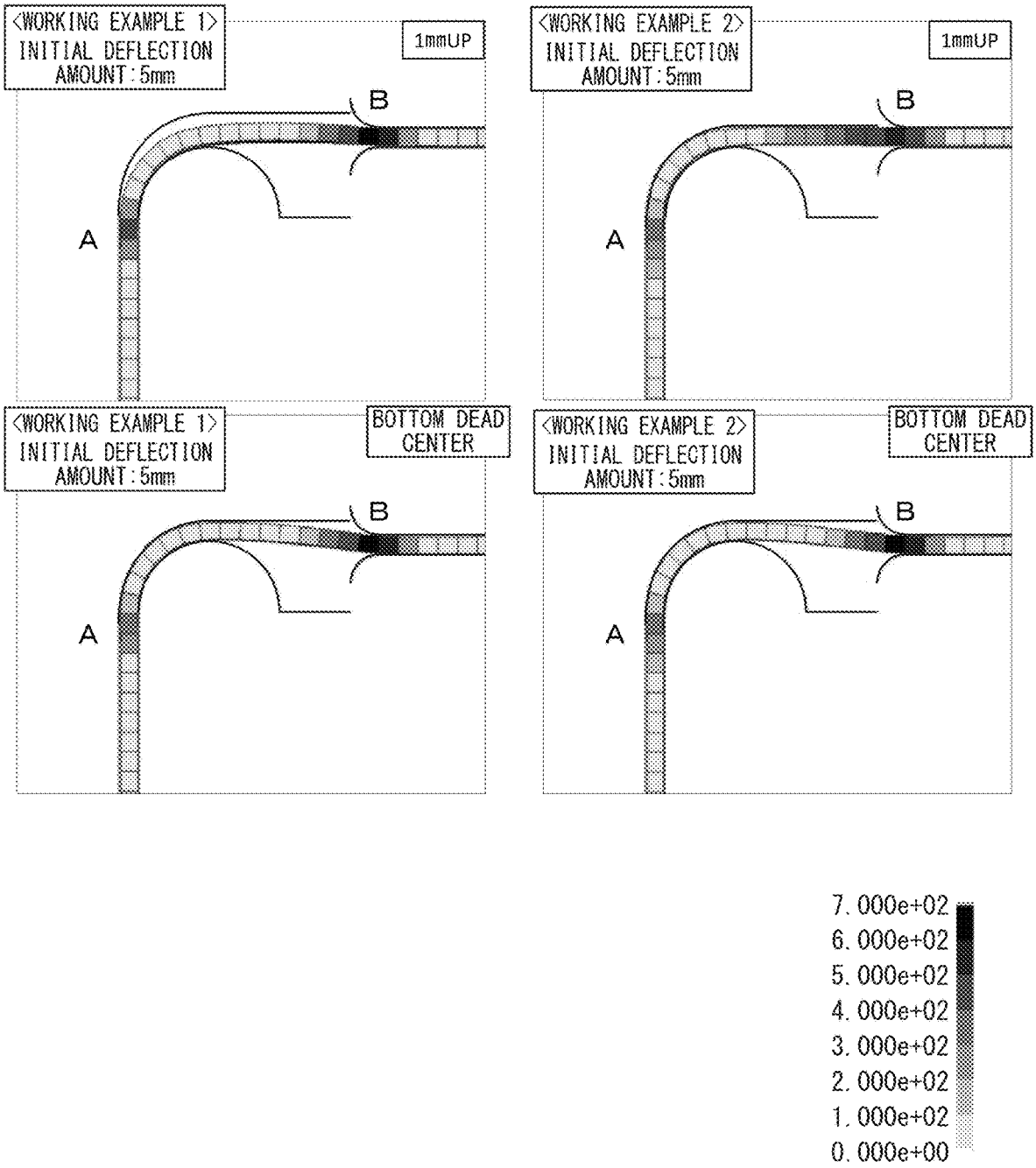
FIG. 13 is an explanatory diagram showing analysis results of the first working example and the second working example.
Figure 14:
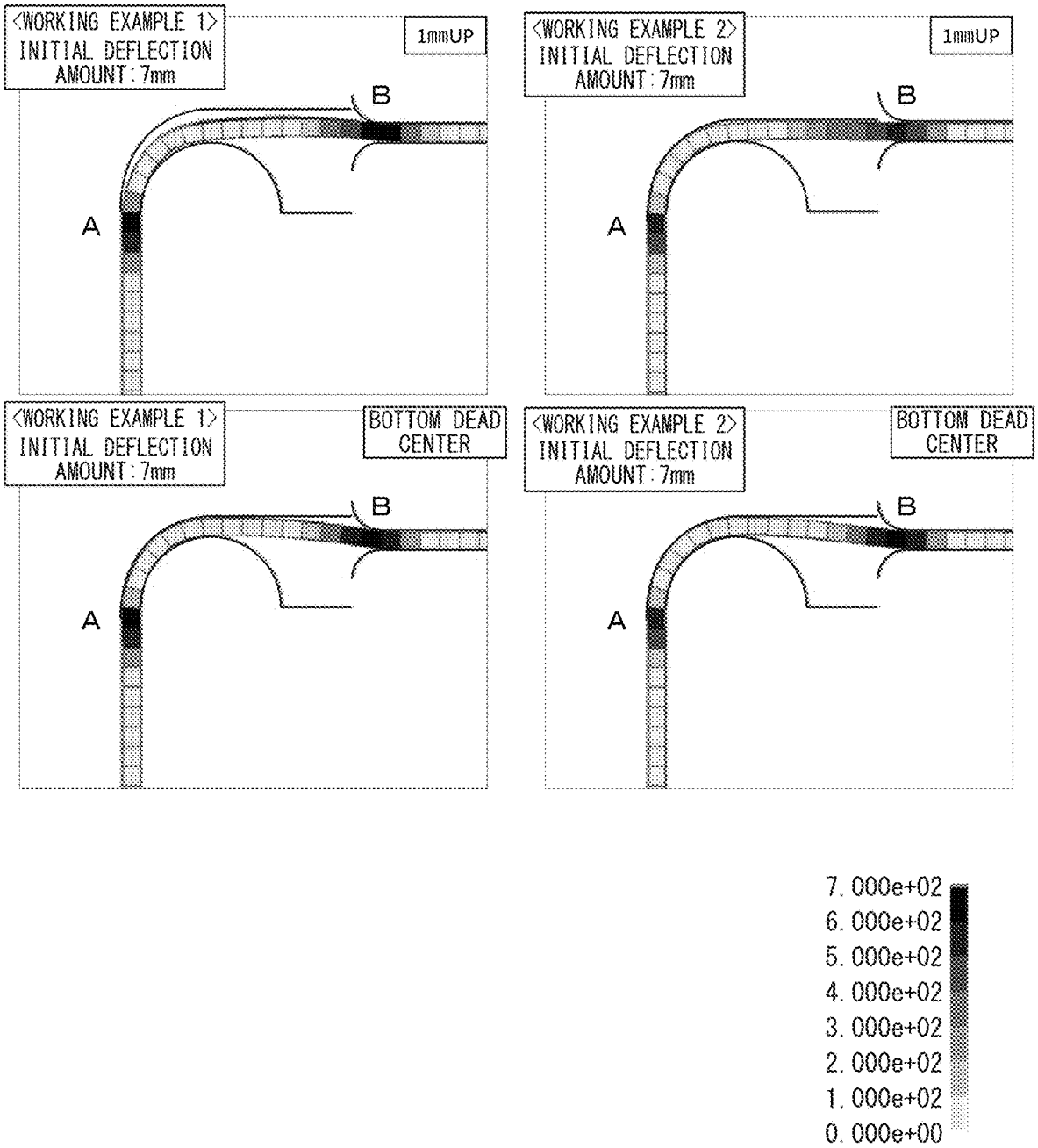
FIG. 14 is an explanatory diagram showing analysis results of the first working example and the second working example.
Figure 15A:
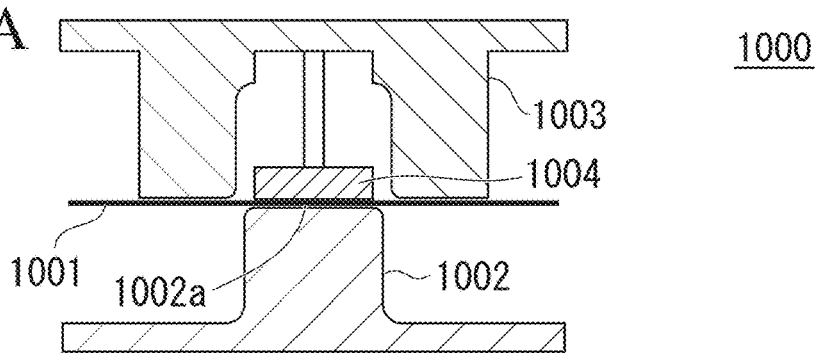
FIG. 15A is a schematic diagram for explaining a press forming method according to a first conventional example, showing a state in which a steel sheet is clamped between a die pad and a punch.
Figure 15B:
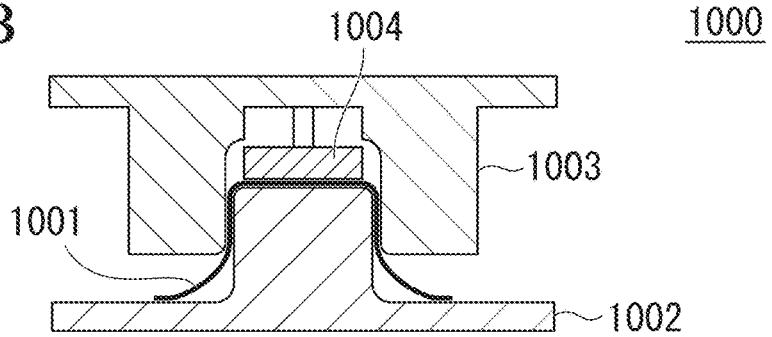
FIG. 15B is a schematic diagram for explaining the press forming method according to the first conventional example, showing a state in which a die is lowered while the steel sheet is clamped between the die pad and the punch.
Figure 15C:
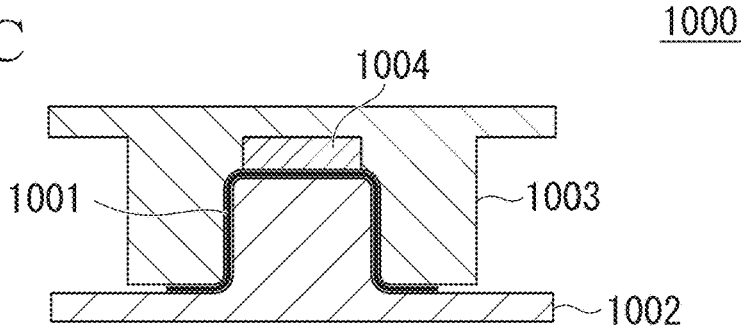
FIG. 15C is a schematic diagram for explaining the press forming method according to the first conventional example, showing a state in which the die and the punch are closest to each other.
Figure 15D:
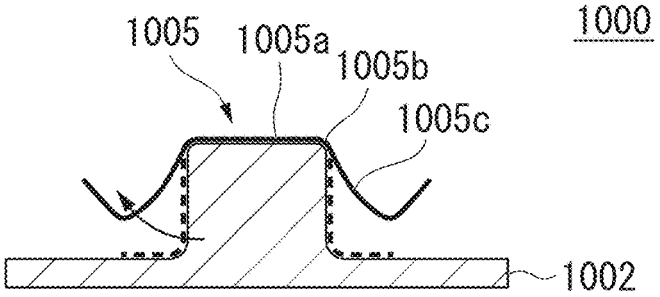
FIG. 15D is a schematic diagram for explaining the press forming method according to the first conventional example, showing a state in which the die is released.

The initial deflection amount was set to 5 mm and 7 mm in the analyses in FIGS. 13 and 14, respectively, for both of the first working example and the second working example and the shape of the press-formed article 30 and the closing direction moment at each of a position higher than the forming bottom dead center by 1 mm and the forming bottom dead center are shown for the first working example and the second working example.

As shown in FIG. 13, in the first working example, since the die bottom end shoulder joint portion is not in contact with the steel sheet S at a position higher than the forming bottom dead center by 1 mm, it is understood that a residual deflection in the region B at the forming bottom dead center is larger than that of the second working example. Meanwhile, in the second working example, since the die bottom end shoulder joint portion comes into contact with the press-formed article 30 before the forming bottom dead center to bend back once and, at the same time, tension is generated in the steel sheet S when pushed by the die pad, it is understood that the residual deflection in the region B at the forming bottom dead center is smaller than that of the first invention example.

In addition, by comparing FIGS. 13 and 14, it is understood that the residual deflection in the portion B in the first working example is larger under the condition that the initial deflection amount is large, while the residual deflection in the portion 13 is smaller and the same degree in the second working example, regardless of the extent of the initial deflection amount.

INDUSTRIAL APPLICABILITY

In a press forming method in which a predetermined amount of deflection is generated in a top sheet from an initial phase of forming while press forming is performed and this deflection is crushed in a later phase of forming as in the inventions disclosed in Patent Documents 1 and 2, the present invention can provide a technology that uses a simple method to enable the enlargement of a setting allowable range of an initial deflection amount for ensuring the dimensional accuracy of opening of a vertical wall and, at the same time, the improvement of the dimensional accuracy of a top sheet surface resulting from the defection generated in an end portion of the top sheet during press forming.

BRIEF DESCRIPTION OF THE REFERENCE SYMBOLS

100, 200, 300, 400 Press forming apparatus
110, 210, 310, 410 Punch
111, 211, 311, 411 Punch shoulder portion
113, 213, 313, 413 Punch shoulder joint portion
115, 215, 315, 415 Punch pad accommodation portion
120, 220, 320, 420 Die
121, 221, 321, 421 Die bottom end shoulder portion
123, 223, 323, 423 Die bottom end shoulder joint portion
125, 225, 325, 425 Die pad accommodation portion
130, 230, 330, 430 Punch pad
135, 235, 335, 435 Punch side blank holding surface
140, 240, 340, 440 Die pad
145, 245, 345, 435 Die side blank holding surface

The invention claimed is:

1. A press forming method of manufacturing a press-formed article from a workpiece sheet comprising the steps of:

providing a press forming apparatus comprising:

a punch formed with a punch shoulder portion, a punch shoulder joint portion, and a punch pad accommodation portion;

a die arranged to oppose the punch and formed with a die bottom end shoulder portion corresponding to the punch shoulder portion, a die bottom end shoulder joint portion, and a die pad accommodation portion provided in the die bottom end shoulder joint portion;

a punch pad arranged in the punch pad accommodation portion and formed with a punch side blank holding surface; and a die pad arranged in the die pad accommodation portion and formed with a die side blank holding surface, pressing the workpiece sheet between the die and the punch, so that the workpiece sheet is clamped between the punch shoulder portion of the punch and the die bottom end shoulder portion of the die, a surface of the workpiece sheet on a die side in a section between a point in contact with the die bottom end shoulder portion and a point in contact with the die pad is in non-contact with the die and the die pad, and an end surface of the punch side blank holding surface adjacent to the punch shoulder portion is flush with the punch shoulder portion or located on a more center side of the punch than the punch shoulder portion.

2. The press forming method according to claim 1, wherein when the workpiece sheet is clamped between the die and the punch, the end surface of the punch side blank holding surface adjacent to the punch shoulder portion is flush with the punch shoulder portion.

3. The press forming method according to claim 2, wherein the workpiece sheet is pressed to bend the workpiece sheet.

4. The press forming method according to claim 2, wherein the die pad is further pushed toward the punch from a state in which the workpiece sheet is clamped between the die and the punch.

5. The press forming method according to claim 4, wherein the workpiece sheet is pressed to bend the workpiece sheet.

6. The press forming method according to claim 1, wherein when the workpiece sheet is clamped between the die and the punch, the end surface of the punch side blank holding surface adjacent to the punch shoulder portion is located on a more center side of the punch than the punch shoulder portion.

7. The press forming method according to claim 6, wherein the workpiece sheet is pressed to bend the workpiece sheet.

8. The press forming method according to claim 1, wherein the workpiece sheet is pressed to bend the workpiece sheet.

9. A press forming apparatus comprising:

a punch having a protrusion, the protrusion formed with a punch shoulder portion, a punch shoulder joint portion, and a punch pad accommodation portion;

a die arranged to oppose the punch and formed with a die bottom end shoulder portion corresponding to the punch shoulder portion, a die bottom end shoulder joint portion, and a die pad accommodation portion provided in the die bottom end shoulder joint portion;

a punch pad arranged in the punch pad accommodation portion and formed with a punch side blank holding surface; and a die pad arranged in the die pad accommodation portion and formed with a die side blank holding surface, wherein the punch shoulder portion is convex a ridgeline, the punch shoulder joint portion is between the punch shoulder portion and the punch pad accommodation portion, the die bottom end shoulder portion is a recess ridgeline, the die bottom end shoulder joint portion is between the die bottom end shoulder portion and the die pad accommodation portion, the protrusion of the punch is formed with a recess portion provided on a more center side of the protrusion than the punch shoulder portion and between the punch shoulder portion and an edge of the punch pad accommodation portion, and the die, the punch, the die pad, and the punch pad are arranged so that when a workpiece sheet is clamped between the punch shoulder portion of the punch and the die bottom end shoulder portion of the die, i) the punch pad moves toward a bottom surface of the punch pad accommodation portion such that the punch side blank holding surface of the punch pad is flush with or lower than an upper surface of the punch shoulder portion, and ii) a surface of the workpiece sheet on a die side in a section between a point in contact with the die bottom end shoulder portion and a point in contact with the die pad is in non-contact with the die and the die pad.

10. The press forming apparatus according to claim 9, wherein in a state in which the punch and the die are closest to each other, the die and the die pad are in non-contact with a residual deflection portion of a workpiece sheet corresponding to an area from the punch shoulder portion to an end portion of the die side blank holding surface of the die pad.

11. The press forming apparatus according to claim 9, further comprising a drive which pushes the die pad toward the punch from a state in which the die and the punch are closest to each other.

12. The press forming apparatus according to claim 9, wherein a width of the die side blank holding surface is substantially equal to a width of the punch side blank holding surface.

13. The press forming apparatus according to claim 9, wherein the press forming apparatus is a cold press forming apparatus.

14. A press forming apparatus comprising:

a punch formed with a punch shoulder portion, a punch shoulder joint portion, and a punch pad accommodation portion;

a die formed with a die bottom end shoulder portion corresponding to the punch shoulder portion, a die bottom end shoulder joint portion, and a die pad accommodation portion provided in the die bottom end shoulder joint portion, the die arranged to oppose the punch so that a workpiece sheet is pressed between the punch shoulder portion and the die bottom end shoulder portion to form a shoulder portion in the workpiece sheet;

a punch pad arranged in the punch pad accommodation portion and formed with a punch side blank holding surface; and a die pad arranged in the die pad accommodation portion and formed with a die side blank holding surface, wherein the punch shoulder portion is a convex ridgeline, the punch shoulder joint portion is between the punch shoulder portion and the punch pad accommodation portion, the die bottom end shoulder portion is a recess ridgeline, the die bottom end shoulder joint portion of the die is formed with a recess portion provided on a more center side of the die than the die bottom end shoulder portion and between the die bottom end shoulder portion and an edge of the die pad accommodation portion, and the die, the punch, the die pad, and the punch pad are arranged so that when a workpiece sheet is clamped between the punch shoulder portion of the punch and the die bottom end shoulder portion of the die, i) the punch pad moves toward a bottom surface of the punch pad accommodation portion such that the punch side blank holding surface of the punch pad is flush with or lower than an upper surface of the punch shoulder portion, and ii) a surface of the workpiece sheet on a die side in a section between a point in contact with the die bottom end shoulder portion and a point in contact with the die pad is in non-contact with the die and the die pad.

15. A press forming apparatus comprising:

a punch formed with a punch shoulder portion, a punch shoulder joint portion, and a punch pad accommodation portion;

a die formed with a die bottom end shoulder portion corresponding to the punch shoulder portion, a die bottom end shoulder joint portion, and a die pad accommodation portion provided in the die bottom end shoulder joint portion, the die arranged to oppose the punch so that a workpiece sheet is pressed between the punch shoulder portion and the die bottom end shoulder portion to form a shoulder portion in the workpiece sheet;

a punch pad arranged in the punch pad accommodation portion and formed with a punch side blank holding surface; and a die pad arranged in the die pad accommodation portion and formed with a die side blank holding surface, wherein the punch shoulder portion is convex a ridgeline, the punch shoulder joint portion is between the punch shoulder portion and the punch pad accommodation portion, the die bottom end shoulder portion is a recess ridgeline, the die bottom end shoulder joint portion is between the die bottom end shoulder portion and the die pad accommodation portion, the punch is provided with the punch pad accommodation portion surrounded by the punch shoulder portion as an edge, a width of the punch side blank holding surface is narrower than a width of the punch pad accommodation portion and an end portion of the punch side blank holding surface is located at a same position as an end portion of the die side blank holding surface on a plane perpendicular to a pressing direction, and the die, the punch, the die pad, and the punch pad are arranged so that when a workpiece sheet is clamped between the punch shoulder portion of the punch and the die bottom end shoulder portion of the die, i) the punch pad moves toward a bottom surface of the punch pad accommodation portion such that the punch side blank holding surface of the punch pad is flush with or lower than an upper surface of the punch shoulder portion, and ii) a surface of the workpiece sheet on a die side in a section between a point in contact with the die bottom end shoulder portion and a point in contact with the die pad is in non-contact with the die and the die pad.

16. A press forming apparatus comprising:

a punch formed with a punch shoulder portion, a punch shoulder joint portion, and a punch pad accommodation portion;

a die formed with a die bottom end shoulder portion corresponding to the punch shoulder portion, a die bottom end shoulder joint portion, and a die pad accommodation portion provided in the die bottom end shoulder joint portion, the die arranged to oppose the punch so that a workpiece sheet is pressed between the punch shoulder portion and the die bottom end shoulder portion to form a shoulder portion in the workpiece sheet;

a punch pad arranged in the punch pad accommodation portion and formed with a punch side blank holding surface; and a die pad arranged in the die pad accommodation portion and formed with a die side blank holding surface, wherein the punch shoulder portion is a convex ridgeline, the punch shoulder joint portion is between the punch shoulder portion and the punch pad accommodation portion, the die bottom end shoulder portion is a recess ridgeline, the die bottom end shoulder joint portion is between the die bottom end shoulder portion and the die pad accommodation portion, the die is provided with the die pad accommodation portion surrounded by an end of the die bottom end shoulder portion as an edge, a width of the die side blank holding surface is narrower than a width of the die pad accommodation portion and an end portion of the die side blank holding surface is located at a same position as an end portion of the punch side blank holding surface on a plane perpendicular to a pressing direction, and the die, the punch, the die pad, and the punch pad are arranged so that when a workpiece sheet is clamped between the punch shoulder portion of the punch and the die bottom end shoulder portion of the die, i) the punch pad moves toward a bottom surface of the punch pad accommodation portion such that the punch side blank holding surface of the punch pad is flush with or lower than an upper surface of the punch shoulder portion, and ii) a surface of the workpiece sheet on a die side in a section between a point in contact with the die bottom end shoulder portion and a point in contact with the die pad is in non-contact with the die and the die pad.

* * * * *